US009704342B2

(12) United States Patent
Aoki et al.

(10) Patent No.: US 9,704,342 B2
(45) Date of Patent: Jul. 11, 2017

(54) SYSTEMS, METHODS, AND DEVICES FOR PLAYING WAGERING GAMES WITH MOVABLE SYMBOL ARRAYS

(71) Applicant: WMS Gaming Inc., Waukegan, IL (US)

(72) Inventors: Dion K. Aoki, Chicago, IL (US); Benjamin T. Gomez, Chicago, IL (US); Pamela S. Smith, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 787 days.

(21) Appl. No.: 13/648,640

(22) Filed: Oct. 10, 2012

(65) Prior Publication Data

US 2013/0095905 A1 Apr. 18, 2013

Related U.S. Application Data

(63) Continuation of application No. 61/546,446, filed on Oct. 12, 2011.

(51) Int. Cl.
*G07F 17/32* (2006.01)

(52) U.S. Cl.
CPC ..... *G07F 17/3265* (2013.01)

(58) Field of Classification Search
CPC ..... G07F 17/3265
See application file for complete search history.

(56) References Cited

U.S. PATENT DOCUMENTS 4,335,809 A * 6/1982 Wain ..... G07F 17/32 463/20
4,448,419 A * 5/1984 Telnaes ..... G07F 17/3244 273/143 R (Continued)

FOREIGN PATENT DOCUMENTS

GB 1391060 * 4/1975 ..... G07F 17/34
GB 2092797 8/1982 ..... G07F 17/34

(Continued)

OTHER PUBLICATIONS

Fey, Slot Machines, A Pictorial History of the First 100 Years, Liberty Belle Books, 1983, pp. 2-4, 20, 27, 214-217.*

*Primary Examiner* — Corbett B Coburn
(74) *Attorney, Agent, or Firm* — Nixon Peabody LLP

(57) ABSTRACT

A gaming system or gaming device for conducting a wagering game includes a display device, a processor, and a memory device. The memory device stores instructions which, when executed by the processor, cause the processor to operate with the display device to determine an outcome of the wagering game, which is randomly determined from plural available wagering-game outcomes, and display, in an array located at a first position on the display device, symbols indicative of the wagering-game outcome. The processor, in conjunction with the memory device, determines a value associated with the wagering-game outcome. The symbol array is then shown moving from the first position to a second position on the display device. The second position is based on a random determination and/or player input. The value of the wagering-game outcome is modified based upon one or more modifiers achieved due to movement of the array to the second position.

24 Claims, 14 Drawing Sheets

(56) References Cited

U.S. PATENT DOCUMENTS

| | | | | |
|---|---|---|---|---|
| 4,636,951 | A * | 1/1987 | Harlick | G07F 9/02 235/380 |
| 4,837,728 | A * | 6/1989 | Barrie | G07F 17/32 273/143 R |
| 5,265,874 | A * | 11/1993 | Dickinson | A63F 3/081 463/25 |
| 5,558,339 | A * | 9/1996 | Perlman | A63F 13/12 463/23 |
| 5,704,835 | A | 1/1998 | Dietz, II | 463/20 |
| 5,833,537 | A | 11/1998 | Barrie | 463/21 |
| 6,056,642 | A | 5/2000 | Bennett | 463/20 |
| 6,089,977 | A | 7/2000 | Bennett | 463/20 |
| 6,251,013 | B1 | 6/2001 | Bennett | 463/13 |
| 6,270,411 | B1 | 8/2001 | Gura et al. | 463/20 |
| 6,280,328 | B1 | 8/2001 | Holch et al. | 463/42 |
| 6,443,837 | B1 | 9/2002 | Jaffe et al. | 463/16 |
| 6,517,433 | B2 | 2/2003 | Loose et al. | 463/20 |
| 6,544,120 | B2 | 4/2003 | Ainsworth | 463/20 |
| 6,561,900 | B1 | 5/2003 | Baerlocher et al. | 463/20 |
| 6,589,114 | B2 | 7/2003 | Rose | 463/20 |
| 6,592,457 | B1 | 7/2003 | Frohm et al. | 463/16 |
| 6,731,313 | B1 | 5/2004 | Kaminkow | 345/839 |
| 6,837,790 | B1 | 1/2005 | Kaminkow | 463/31 |
| 6,855,054 | B2 | 2/2005 | White et al. | 463/21 |
| 6,869,360 | B2 | 3/2005 | Marks et al. | 463/25 |
| 6,896,617 | B2 | 5/2005 | Daly | 463/20 |
| 6,939,228 | B2 | 9/2005 | Shimizu | 463/20 |
| 6,981,635 | B1 | 1/2006 | Hughs-Baird et al. | 235/375 |
| 7,077,745 | B2 | 7/2006 | Gomez et al. | 463/20 |
| 7,108,602 | B2 | 9/2006 | Daly | 463/20 |
| 7,195,559 | B2 | 3/2007 | Gilmore et al. | 463/20 |
| 7,232,371 | B2 * | 6/2007 | Gatto | G07F 17/3248 463/25 |
| 7,351,144 | B2 | 4/2008 | Daly | 463/20 |
| 7,357,713 | B2 | 4/2008 | Marks et al. | 463/16 |
| 7,361,089 | B2 | 4/2008 | Daly et al. | 463/20 |
| 7,371,170 | B2 | 5/2008 | Cregan et al. | 463/20 |
| 7,396,279 | B2 | 7/2008 | Berman et al. | 463/16 |
| 7,553,231 | B2 | 6/2009 | Rodgers et al. | 463/20 |
| 7,578,735 | B2 | 8/2009 | Frizzell et al. | 463/20 |
| 7,601,062 | B2 | 10/2009 | Cole et al. | 463/20 |
| 7,654,895 | B2 | 2/2010 | Pacey | 463/16 |
| 7,674,173 | B2 | 3/2010 | Bennett | 463/20 |
| 7,695,365 | B2 | 4/2010 | Casey | 463/20 |
| 7,704,141 | B1 | 4/2010 | Marks et al. | 463/20 |
| 7,744,455 | B2 | 6/2010 | Aida | 463/16 |
| 7,744,458 | B2 | 6/2010 | Marks et al. | 463/20 |
| 7,837,546 | B2 | 11/2010 | Bennett et al. | 463/16 |
| 7,950,994 | B2 | 5/2011 | Berman et al. | 463/20 |
| 2003/0045354 | A1 | 3/2003 | Giobbi | 463/40 |
| 2004/0097280 | A1 | 5/2004 | Gauselmann | 463/16 |
| 2004/0229679 | A1 | 11/2004 | Anderson et al. | 463/20 |
| 2006/0058097 | A1 | 3/2006 | Berman et al. | |
| 2008/0032784 | A1 | 2/2008 | Englman | 463/21 |
| 2009/0069071 | A1 | 3/2009 | Aoki et al. | 463/20 |
| 2009/0088242 | A1 | 4/2009 | Richardson | |
| 2009/0239631 | A1 | 9/2009 | Aoki et al. | 463/20 |
| 2009/0253491 | A1 | 10/2009 | Gomez et al. | 463/20 |
| 2010/0137055 | A1 | 6/2010 | Jaffe | |
| 2011/0045892 | A1 | 2/2011 | Vann et al. | 463/20 |

FOREIGN PATENT DOCUMENTS

| | | | |
|---|---|---|---|
| GB | 2096376 | 10/1982 | G07F 17/32 |
| GB | 2097160 | 10/1982 | G07F 17/34 |
| GB | 2119991 | 11/1983 | G07F 17/32 |
| GB | 2137392 | 10/1984 | G07F 17/32 |
| WO | 2007/089410 | 8/2007 | A63F 17/32 |

* cited by examiner

SYSTEMS, METHODS, AND DEVICES FOR PLAYING WAGERING GAMES WITH MOVABLE SYMBOL ARRAYS

CROSS-REFERENCE AND CLAIM OF PRIORITY TO RELATED APPLICATION

This application claims the benefit of and priority to U.S. Provisional Patent Application No. 61/546,446, which was filed on Oct. 12, 2011, and is incorporated herein by reference in its entirety.

COPYRIGHT

A portion of the disclosure of this patent document contains materials which are subject to copyright protection. The copyright owner has no objection to the facsimile or electronic reproduction by anyone of the patent disclosure, as it appears in the U.S. Patent and Trademark Office patent files or records, but otherwise reserves all copyright rights whatsoever.

TECHNICAL FIELD

The present disclosure relates generally to wagering games, as well as wagering game terminals and gaming systems. More particularly, the present disclosure relates to systems, methods, and devices for playing wagering games with symbol-based outcomes that are displayed in a symbol array.

BACKGROUND

Gaming machines, such as slot machines, video poker machines, video black-jack machines, and the like, have been a cornerstone of the gaming industry for several years. Generally, the popularity of such machines with players is dependent on the likelihood (or perceived likelihood) of winning money at the machine and the intrinsic entertainment value of the associated wagering game relative to other available gaming options. Where the available gaming options include a number of competing machines and the expectation of winning at each machine is roughly the same (or believed to be the same), players are likely to be attracted to the most entertaining and exciting machines. Shrewd operators therefore strive to employ the most entertaining and exciting machines, features, and enhancements available because such machines attract frequent play and hence increase profitability to the operator.

Numerous gaming enhancements are available to enhance player entertainment and achieve player loyalty, including offering new and different ways of achieving winning outcomes based on player interaction with the wagering game. Such interactions, however, are typically limited to bonus game features and are tangential to the symbol-driven outcomes of the base game. While some currently available game features provide some enhanced entertainment and excitement, there is a continuing need to develop new features for wagering games to satisfy the ever-changing demands of players and operators. Such new features will further enhance player entertainment and excitement, perpetuate player loyalty, and thus increase game play.

SUMMARY

Aspects of this disclosure are directed towards wagering games, such as slot-type reel games, with outcomes that are displayed to players as an array of symbols. Related features of this disclosure include visually moving the entire symbol array, as a unit, relative to modifiers positioned outside the original position of the array. This may then include evaluating (or reevaluating) the array, for example, at its landing position based upon such modifiers. In one example, the player uses a touchscreen or other input device to initiate movement of the array relative to the modifiers, which may be in the form of multiplier zones, for example. In another example, the wagering game moves the array, without direct player input, relative to a field of symbol modifiers, which may be in the form of wild symbols, for example. Features disclosed herein can leverage elongated display devices, portrait-oriented display screens, large community display screens, multiple display screen setups, etc.

According to aspects of the present disclosure, a gaming system for conducting a wagering game is presented. The gaming system includes an input device for receiving a wager to play the wagering game, a display device for displaying outcomes of the wagering game, and one or more processors connected to the display device. The gaming system also includes at least one memory device. The memory device stores a plurality of instructions which, when executed by the one or more processors, cause the processor(s) to operate with the display device to: determine an outcome of the wagering game, the wagering-game outcome being randomly determined from a plurality of wagering-game outcomes; display, in an array located at a first position on the display device, a plurality of symbols indicative of the wagering-game outcome; move the array from the first position to a second position on the display device; and modify the value of the wagering-game outcome based upon one or more modifiers achieved due to movement of the array to the second position.

According to other aspects of the present disclosure, a gaming system for conducting a wagering game is presented. The gaming system includes at least one input device, at least one display device, and at least one processor. The gaming system also includes at least one memory device that stores a plurality of instructions which, when executed by the at least one processor, cause the at least one processor to operate with the at least one display device and the least one input device to: receive an indication of a wager from a player; determine an outcome of the wagering game, the wagering-game outcome being randomly determined from a plurality of wagering-game outcomes; display, in an array located at a first position on the display device, a plurality of symbols indicative of the wagering-game outcome; determine a value associated with the wagering-game outcome; move the entire array, as a unit, from the first position to a second position on the display device, the second position being distinct from the first position; and modify the value of the wagering-game outcome based upon one or more modifiers achieved due to movement of the array to the second position.

According to further aspects of the present disclosure, a computer-implemented method of conducting a wagering game on a gaming device is featured. The method includes: receiving an indication of a wager via one or more input devices; determining, via at least one of one or more processors, an outcome of the wagering game, the outcome being randomly determined from a plurality of wagering-game outcomes; displaying, in an array located at a first position on a display device, a plurality of symbols indicative of the wagering-game outcome; moving the entire array of symbols, as a unit, from the first position to a second position on the display device; and modifying a value of the wagering-game outcome based upon one or more modifiers achieved due to movement of the array to the second position.

According to even yet another aspect of the present disclosure, one or more non-transient computer-readable storage media are encoded with instructions for directing a gaming device or a gaming system to perform any of the methods disclosed herein. For instance, a computer program product is disclosed which comprises a non-transient computer-readable medium having an instruction set borne thereby, the instruction set being configured to cause, upon execution by one or more controllers, the acts of: receiving an indication of a wager; determining an outcome of the wagering game, the outcome being randomly determined from a plurality of wagering-game outcomes; directing a display device to display, in an array located at a first position, a plurality of symbols indicative of the wagering-game outcome; directing the display device to display a plurality of modifiers each positioned at a respective location outside of the first position of the array; directing the display device to display the entire array of symbols moving, as a single unit, from the first position to a second position on the display device; and modifying a value of the wagering-game outcome based upon one or more modifiers achieved due to movement of the array to the second position.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and best modes for carrying out the present invention when taken in connection with the accompanying drawings and the appended claims.

Figure 1A:
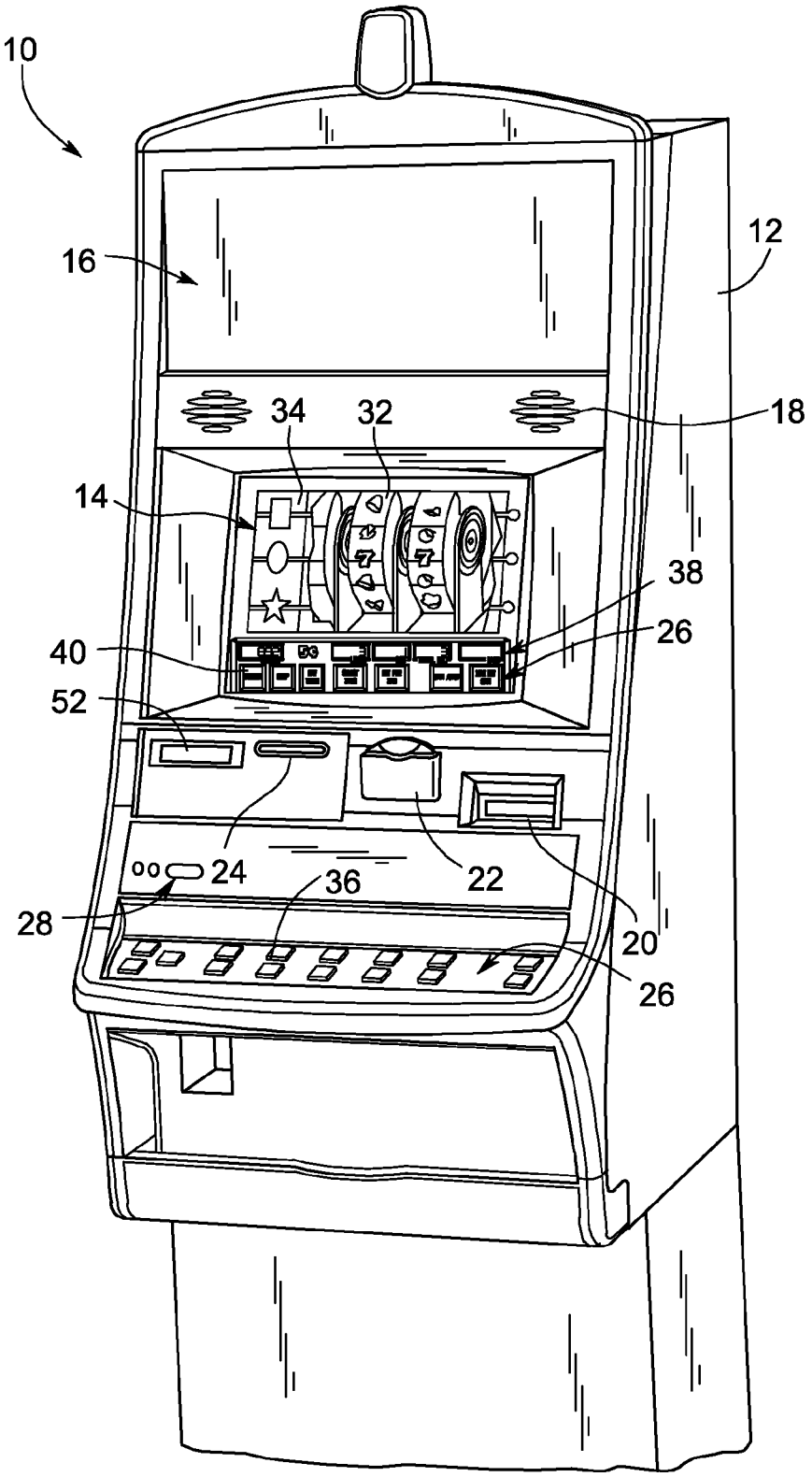
FIG. 1A is a perspective-view illustration of an example of an upright free-standing gaming terminal in accordance with aspects of the present disclosure.

While the aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EXAMPLES

While this invention is susceptible of embodiment in many different forms, there are shown in the drawings and will herein be described in detail embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1A, there is shown a gaming terminal 10 similar to those used in conventional gaming establishments, such as casinos, hotels and cruise ships, and non-conventional gaming establishments, such as airports and restaurants. With regard to the present disclosure, the gaming terminal 10 may be any type of gaming terminal and may have varying structures and methods of operation. For example, in some aspects, the gaming terminal 10 can be an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, such as the terminal 100 of FIG. 1B, a portable or handheld device primarily used for gaming, such as is disclosed by way of example in PCT Patent Application No. PCT/US2007/000792 filed Jan. 11, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic and computing devices, such as a laptop computer, portable television, MP3 player, entertainment device, etcetera.

The gaming terminal 10 illustrated in FIG. 1A comprises a cabinet or housing 12. For output devices, this embodiment of the gaming terminal 10 includes a primary display area 14 (or "primary display device"), a secondary display area 16 (or "secondary display device"), and one or more audio speakers 18. The primary display area 14 and the secondary display area 16 can each variously display information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1A includes a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 includes, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1A. The primary display area 14 includes, in relation to many aspects of wagering games conducted on the gaming terminal 10, one or more paylines 30 (see FIG. 3) extending along a portion of the primary display area. In the illustrated embodiment of FIG. 1A, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1A is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and the secondary display area 16 can be rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 can include, in some non-limiting examples, a plurality of buttons 36 on a button panel, as shown in FIG. 1A, a mouse, a joy stick, a switch, a microphone, a touch screen 38 mounted over one of the display areas (e.g., the primary display area 14 or the secondary display area 16) and having one or more soft touch keys 40, as is also shown in FIG. 1A. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s)

at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354, published on Mar. 6, 2003, entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 1B:
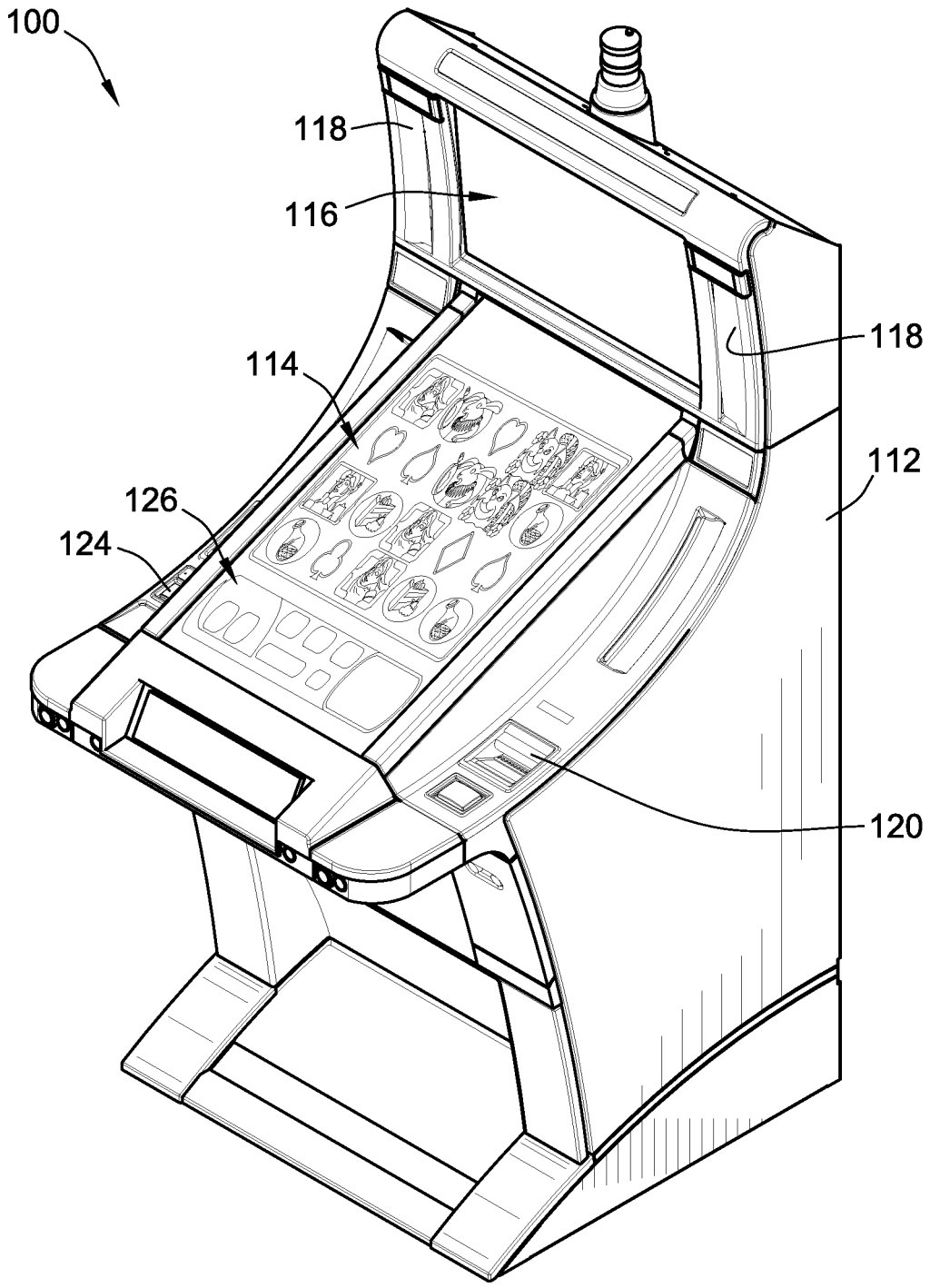
FIG. 1B is a perspective-view illustration of an example of a slant-top free-standing gaming terminal in accordance with aspects of the present disclosure.

Referring now to FIG. 1B, a representative gaming terminal or machine 100 of the "slant-top" type is shown in accord with at least some aspects of the disclosed concepts. Although differing in appearance, the gaming terminal 100 can be similar in function, operation, and connectivity to the gaming terminal 10 discussed above with respect to FIG. 1A. For instance, the gaming terminal 100 may be an electromechanical gaming terminal configured, for example, to play mechanical slots, or it may be an electronic gaming terminal configured, for example, to play a video casino game, such as keno, poker, slots, blackjack, roulette, or a combination of both. Markedly, the gaming terminal 100 of FIG. 1B is purely representative in nature, and presented solely for explanatory purposes. As such, the aspects of the present disclosure are in no way limited to the terminal configurations shown in the drawings.

The illustrated gaming terminal 100 comprises a cabinet 112 for housing and supporting a variety of operational and peripheral componentry (e.g., CPU 42, memory 44, external systems interface 58, etc.). For output devices, the gaming terminal 100 includes a primary display area (or "first display device") 114, an optional secondary display area (or "second display device") 116, and one or more audio speakers 118. These display devices 114, 116 can take on any of the possible types, include any of the optional features, and can operate in any manner described above with respect to the various displays of the gaming machine 10 of FIG. 1A. For input devices, the gaming terminal 100 may include, in any combination, a bill-receiving and validating device 120, a coin acceptor, one or more information readers 124, one or more player-input devices 126, and one or more player-accessible ports (e.g., an audio output jack for headphones, a video headset jack, an internet cable jack, a wireless transmitter/receiver, etc.). While these typical components found in the gaming terminal 100 are described above, it should be understood that numerous additional/alternative peripheral devices and other elements may exist and may be used in any number of combinations to create various forms of a gaming terminal.

Figure 2:
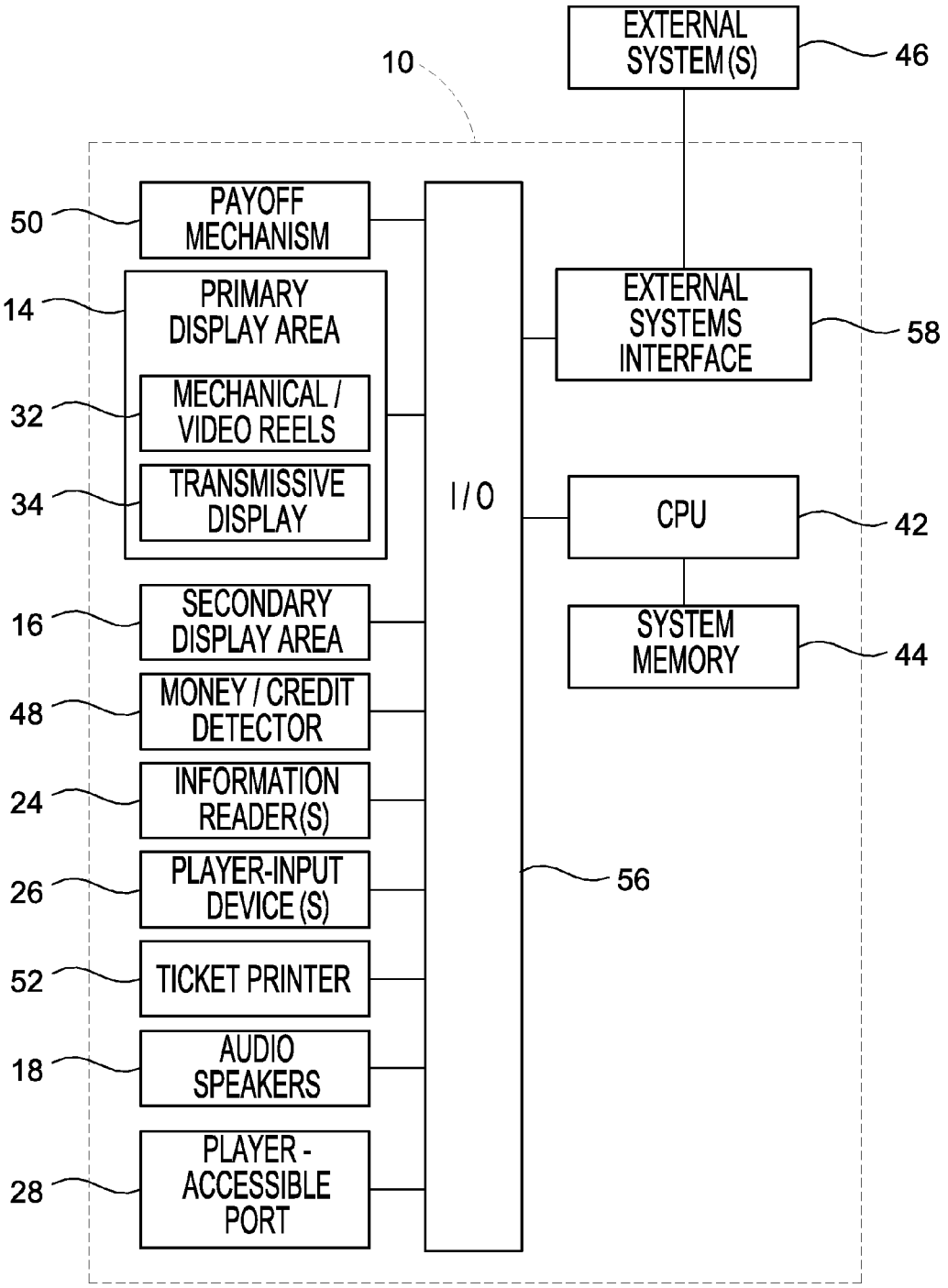
FIG. 2 is a schematic diagram of an exemplary gaming system according to aspects of the present disclosure.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises, singly and in any combination, hardware, software, and firmware disposed inside or outside (or both) of the gaming terminal 10 that is configured to communicate with or control (or both) the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering-game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal to the controller 42 that money, credits, or other form of wager have been input via one or more value-input devices, such as the bill validator 20, coin acceptor 22, or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device(s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs are typically paid out in coins, currency bills, electronic credits, and combinations thereof, payoffs are alternatively associated with a coded ticket (from a ticket printer 52), a portable storage medium or device (e.g., a card magnetic strip), or are transferred to or transmitted to a designated player account. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+front-side bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10 bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46

("thin client" gaming terminal), or are distributed therebetween in any suitable manner ("intermediate client" gaming terminal).

Figure 3:
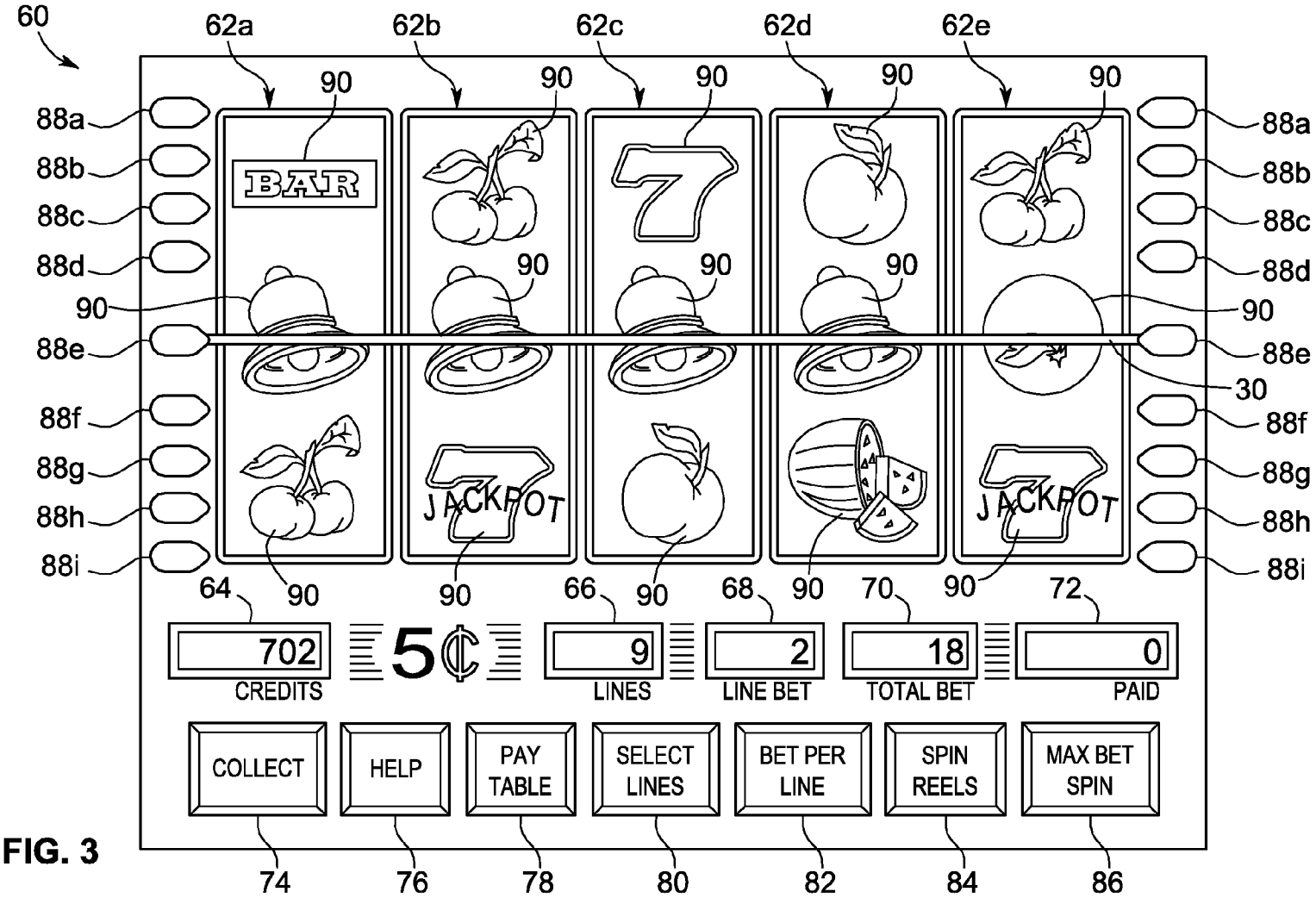
FIG. 3 is a screen shot of a basic-game screen from an exemplary wagering game that can be played, for example, on the gaming terminals of FIG. 1A or 1B or the gaming system of FIG. 2.

Referring now to FIG. 3, an image of a basic-game screen 60 adapted to be displayed on the primary display area 14 is illustrated, according to one embodiment of the present disclosure. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accordance with various methods of conducting a wagering game on a gaming system in accord with the present concepts, the wagering game includes a game sequence in which a player makes a wager, such as through the money/credit detector 48, touch screen 38 soft key, button panel, or the like, and a wagering-game outcome is associated with the wager. The wagering-game outcome is then revealed to the player in due course following initiation of the wagering game. The method comprises the acts of conducting the wagering game using a gaming apparatus, such as the gaming terminal 10 depicted in FIG. 1A, following receipt of an input from the player to initiate the wagering game. The gaming terminal 10 then communicates the wagering-game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14, another display device, other output devices (e.g., speakers, lights, communication device, etc.), singly or in combination, to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some aspects, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present disclosure does not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present disclosure. Additionally, though an embodiment with five reels is shown in FIG. 3, different embodiments of the gaming terminal 10 comprise a greater or lesser number of reels in accordance with the present disclosure.

Figure 4:
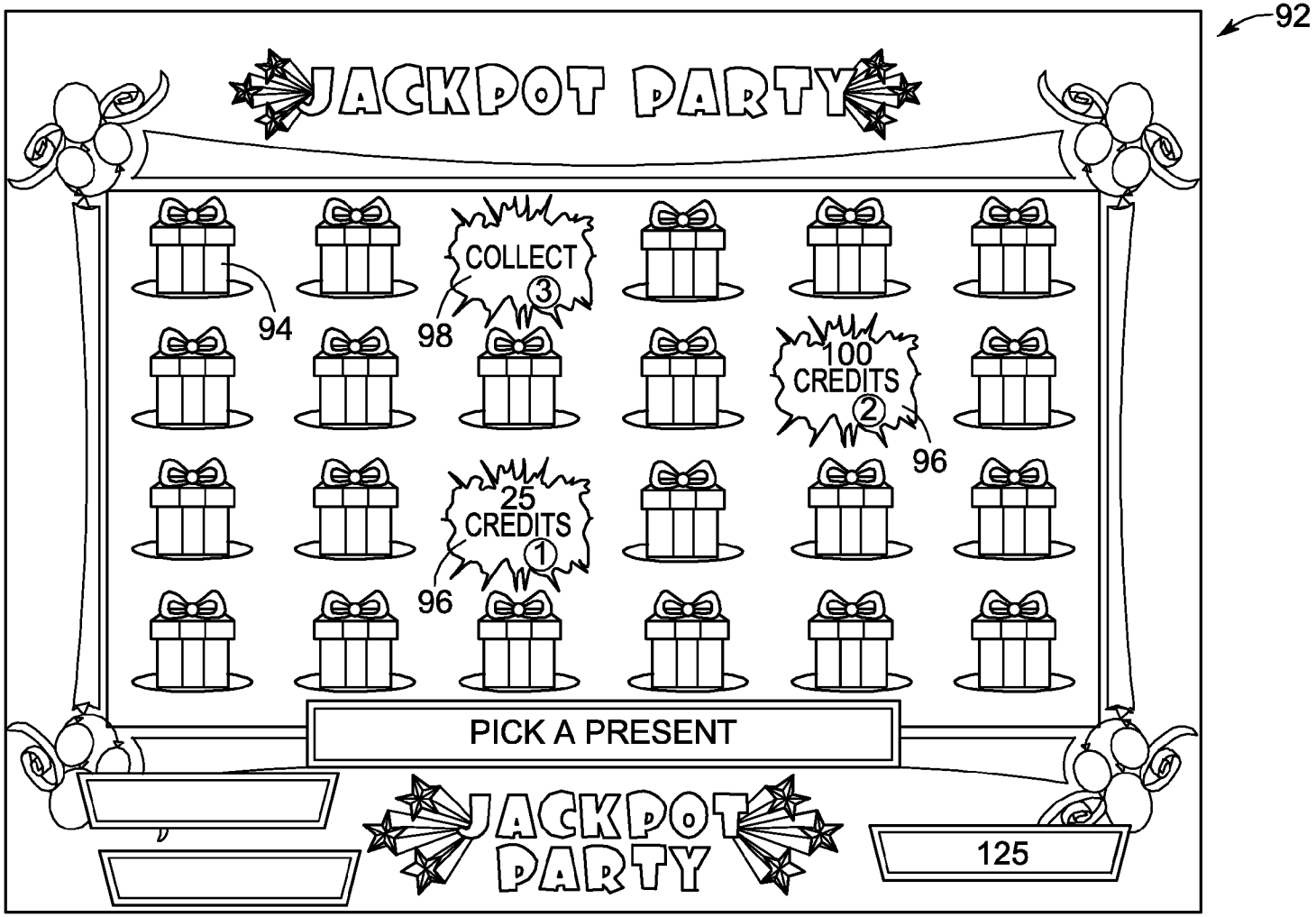
FIG. 4 is a screen shot of a bonus-game screen from an exemplary wagering game that can be played, for example, on the gaming terminals of FIG. 1A or 1B or the gaming system of FIG. 2.

Turning now to FIG. 4, an example of a bonus game to a basic wagering game is illustrated. A bonus-game screen 92 includes an array of markers 94 located in a plurality of columns and rows. The bonus game is entered upon the occurrence of a triggering event, such as the occurrence of a start-bonus game outcome (e.g., symbol trigger, mystery trigger, time-based trigger, etc.) in or during the basic wagering game. Alternatively, any bonus game described herein is able to be deployed as a stand-alone wagering game independent of a basic wagering game.

In the illustrated bonus game of FIG. 4, a player selects, one at a time, from the array of markers 94 to reveal an associated bonus-game outcome. According to one embodiment of this bonus game, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5:
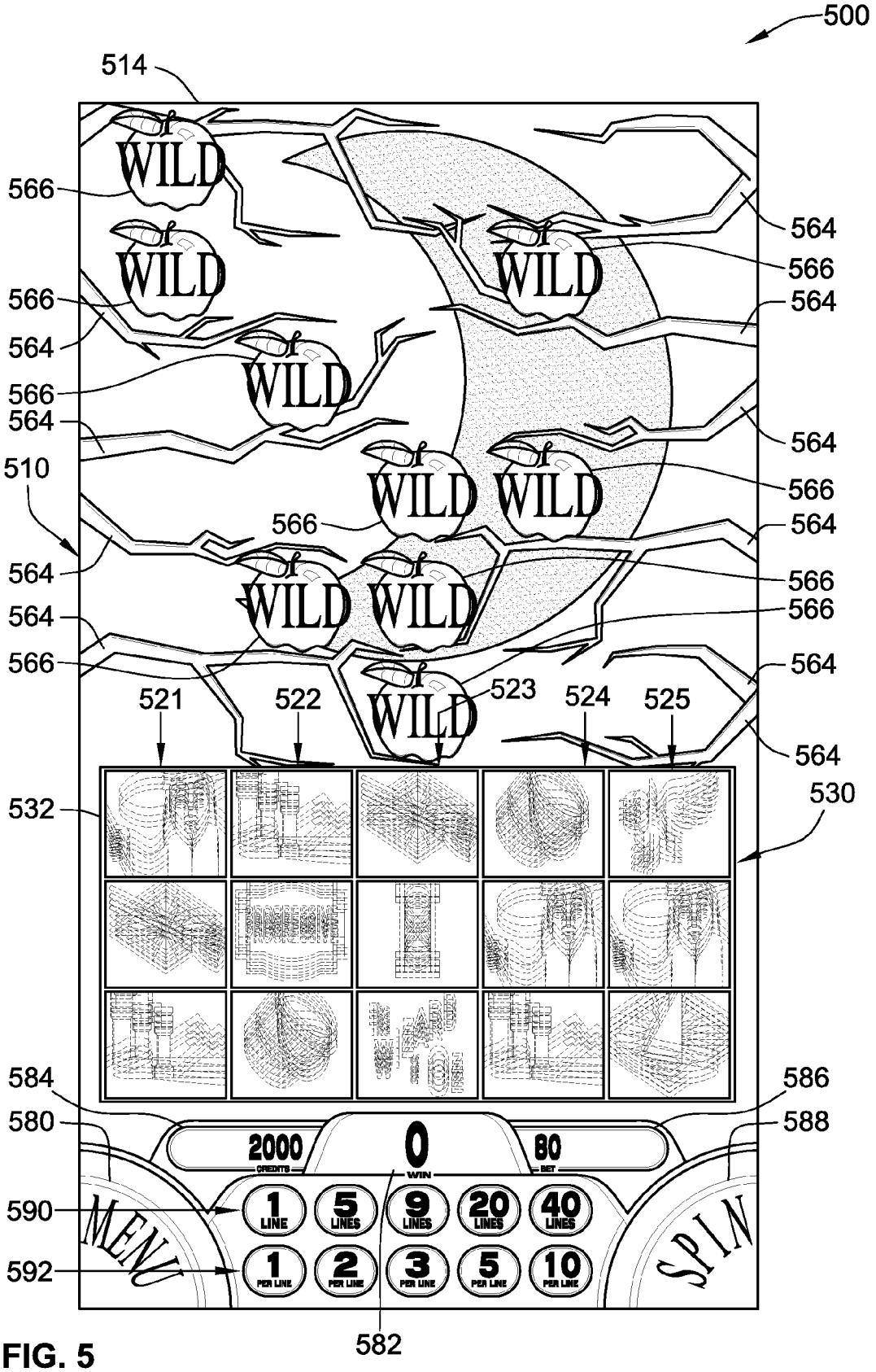
FIG. 5 is a screen shot of a bonus-game screen from an exemplary wagering game in accordance with aspects of the present disclosure.

FIG. 5 is a screen shot of a game screen from an exemplary wagering game in accordance with aspects of the present disclosure. A primary display 514 of a gaming device or terminal 510, which may be part of an exemplary gaming system 500, is shown is FIG. 5. The gaming terminal 510 of FIG. 5 can take on various alternative configurations, including, without limitation, upright freestanding gaming machines (e.g., gaming terminal 10 of FIG. 1A), slant-top freestanding gaming machines (e.g., gaming terminal 100 of FIG. 1B), handheld gaming machines, countertop gaming machines, personal computers or laptop computers, or other known gaming devices, individually or in any combination thereof. The primary display 514 of the gaming terminal 510 displays wagering games, such as those described above with respect to FIGS. 3 and 4 or those described below with respect to FIGS. 5-13, for example. The display 514 may be any form of display, such as those described with reference to the free-standing gaming terminal 10 of FIG. 1A. For instance, the primary display 514 may comprise a plasma, LED, OLED, LCD, CRT, projection, or any other now-known or later-developed display device. Although numerous aspects of the wagering game 530 are all shown displayed on a single display device (i.e., the primary display 514), these aspects are not so limited and can be displayed in any combination on any number of display devices unless otherwise expressly prohibited.

The display 514 displays or otherwise visually depicts a wagering game 530, which in this example is the slot game shown in FIG. 5. The slot game 530 includes a plurality of symbol-bearing reels, designated generally as 521-525, respectively, each having a plurality of distinct symbol positions and bearing a number of symbols (collectively represented by symbols 560-562 in FIG. 6). The symbols may include any variety of graphical symbols, emblems, elements, or representations, including symbols that are associated with one or more themes of the gaming terminal 510 and gaming system 500 (e.g., The Wizard of Oz™). The symbols may also include a blank symbol or empty space. The symbols on the reels 521-525 are arranged in an array 532, which in this embodiment is a 3×5 matrix of symbols. The reels 521-525 are varied (e.g., spun and stopped) to reveal combinations of symbols in the array 532, which represent randomly selected outcomes of the wagering game 530, that are evaluated for winning combinations. Winning combinations of symbols landing, for example, on activated paylines (e.g., those paylines for which a wager has been received), cause awards to be paid in accordance with one or more pay tables associated with the gaming system 500.

Within the scope of this disclosure, the wagering game 530 can include greater or fewer than five symbol-bearing reels (simulated, mechanical, or otherwise) and, in some embodiments, greater or fewer symbol positions than those shown in FIG. 5. In alternate embodiments, the randomly selected outcomes may comprise greater or fewer than 15 symbols, and may take on a variety of different forms having greater or fewer rows and/or columns. The matrix may even comprise other non-rectangular forms or arrangements of symbols. Moreover, the randomly selected outcomes of the wagering game 530 may be varied from the representation provided in FIG. 5. Likewise, The Wizard of Oz™ game theme is purely illustrative and non-limiting in nature.

The primary display 514 further includes certain display features for providing information and options to a player. For example, the display 514 features may include a MENU button 580, a WIN meter 582, a CREDITS meter 584, a BET meter 586, and a SPIN button 588. The MENU button 580 can be pressed and activated (e.g., through an overlying touch screen) by a player desiring to access other control menus, preferences, help screens, etc. For example, the player can change a theme of the wagering game 530 via the MENU button 580, or change the type of wagering game being played (e.g., to video poker, blackjack, keno, etc.). The WIN meter 582 displays to the player the amount of the total win (if any) from the most recent play of the wagering game 530. The CREDITS meter 584 displays to the player the total amount of credits (if any) remaining and available to the player for play of the wagering game 530. The BET meter 586 displays to a player the current size of his/her wager (in credits). Once a number of paylines are selected and a wager is placed, the SPIN button 588 can be pressed or otherwise activated by a player to effectuate rotation of the reels 521-525. In an optional configuration, selection of the SPIN button 588 will effectuate rotation of the reels 521-525 without requiring prior selection of a wager and/or a number of paylines (e.g., a default wager and a default number of payline(s) are automatically chosen upon selection of the SPIN button 588).

Fewer, additional or alternative display features may be included for presenting information and/or options to a player. In one specific instance, a row of player-selectable LINES buttons 590 gives a player the option of quickly selecting and activating a predetermined number of paylines (e.g., 1, 5, 9, 20 or 40 lines). Another option would be to display a row of player-selectable PER LINE buttons 592, which gives a player the option of quickly selecting a predetermined bet per payline (e.g., 1, 2, 3, 5 and 10 credits per activated payline). The primary display 514 can also include, for example, an optional change-denomination button (not shown) that can be activated to change the denomination of wagers which the player is inputting into the system 500. Other features may include, in some non-limiting examples, one or more bet change buttons that permit a player to incrementally increase and/or decrease the size of his/her wager, a "max bet spin" button for wagering a maximum number of credits and contemporaneously varying the reels of the wagering game 530, as well as any of the buttons and meters displayed in FIG. 3 or other features now known or hereinafter developed.

The wagering game 530 is shown in FIG. 5 after play of a base game or bonus game segment is initiated, for example, by the player providing a wager and thereafter pressing a spin button or pulling a spin lever. The monetary wager (e.g., a selected number of credits) is deducted from the available credits, as displayed via the CREDITS meter 584. The monetary wager that is in play can be displayed via the BET meter 586. FIG. 5 illustrates the reels 521-525 being varied—e.g., spun and stopped; the reels 521-525 continue to spin until they are stopped to reveal combinations of symbols which represent a randomly selected outcome of the wagering game. The wagering-game outcome is, according to some aspects, randomly determined from a plurality of potential wagering-game outcomes. As indicated above, each outcome is evaluated for winning combinations—to determine if the displayed outcome has one or more awards associated therewith.

A local controller (e.g., CPU 42 of FIG. 2), a host system (e.g., external system 46 of FIG. 2), a central controller, or any combination thereof, in alternative embodiments, operates to execute the wagering game program causing the display area 514 to display selected portions of the wagering game 530. An outcome of the wagering game can be randomly selected from a plurality of potential wagering-game outcomes (e.g., using a local random number generator (RNG)). The wagering-game outcome is then revealed, displayed, or otherwise communicated to the player, for example, on a corresponding display 514. In FIG. 5, the game screen 514 displays the wagering-game outcome by portraying the plurality of simulated reels 521-525 spinning and stopping to reveal a plurality of symbols arranged in a 3-row, 5-column matrix. A winning combination occurs, for example, when the displayed symbols correspond to one or more of the winning symbol combinations listed in a pay table. In response, a wagering-game prize (also referred to as "wagering-game award") associated with a winning outcome is conferred upon the player.

During play of the wagering game 530, which may include any time just prior to, during, or after which the reels 521-525 are being spun and stopped, or any time that a player is present at the gaming terminal 510, certain triggering events may trigger activation of one or more gaming features or special events. In the illustrated embodiment, for example, a Flying-Monkey Wild Feature, which may be embodied in a basic game, a bonus game (e.g., a free-spin bonus-game feature), or any other segment of the wagering game 530, is triggered as a result of a triggering event during the most recent play of the wagering game 530. In alternate embodiments, the triggering event is dependent on the displayed outcome of the wagering game, for example, a symbol-driven ("symbol-based") triggering event. A symbol-driven triggering event, may comprise, for example, three or more symbols aligning on an active payline, symbols being arranged in predetermined patterns in the array 532, or a triggering symbol(s) appearing anywhere in the displayed outcome of the wagering game 530. In other embodiments, player selection of an appropriate selectable element may reveal an indication of a triggering event. In yet other embodiments, the outcome-based triggering events may include accumulation of certain assets or advancement to certain stages or episodes within the game. As is well known, there may be eligibility requirements incorporated into the wagering game for the player to initiate a triggering event.

Other triggers may be based upon the time playing the wagering game 530 ("time on device") or the size and/or number of wagers. According to one specific example, in an embodiment, one or more of the progressive jackpots 550-554 may be triggered in a "mystery" fashion. A mystery trigger is a trigger that is generally independent of the displayed outcome(s) of the wagering game 530. Instead, a mystery triggering event is communicated to the player when it occurs, but the player may be unaware of what caused the triggering event. Such "mystery" triggering events may be driven by a number of mechanics that are not observable by the player. For example, the mystery trigger may be a randomly selected event, such as intermittently randomly selecting a number from a pool of numbers until the selected number matches a triggering number or range of numbers. In yet other embodiments, mystery triggering events may include a threshold time playing a wagering game 530 (time on device), total wagers input meeting a predetermined amount (coin in), accumulation of a certain amount of credits, points, or assets, etc.

A Flying-Monkey Wild Feature is randomly triggered as a result of a triggering event during the most recent play (e.g., a wagered spin) of the wagering game 530 shown in FIG. 5. As will be readily apparent from the following description, many aspects of the Flying-Monkey Wild Feature depicted in FIGS. 5-8 are amendable or otherwise adaptable for incorporation into various aspects of wagering games, including, without limitation, basic game segments, bonus game segments, community games, progressive games, etc. Once triggered, one or more modifiers are then dispersed throughout the display screen 514, each positioned at a respective location outside of the current position of the array 532, which may be representative of a "first position." In the illustrated embodiment, for example, the display 514 depicts throngs of branches 564 growing into and over the screen, above the spinning reels 521-525. The modifiers, which are represented in FIG. 5 by apple-shaped WILD modifier symbols, some of which are labeled 566, begin growing on the branches 564 at different locations throughout the display screen 514. In this particular embodiment, each modifier symbol 566 is initially located outside of the array 532 at a respective position on the display device 514, vertically aligned with at least one of the symbol-bearing reels 521-525. Some of the modifier symbols 566 are also shown in rows, horizontally aligned with other modifier symbols 566.

It should be understood that the individual and relative positioning of each modifier symbol 566 can be varied from what is shown in the drawings without departing from the intended scope and spirit of the present disclosure. Moreover, the number of available modifiers may be varied from the nine presented in FIGS. 5 and 6. To that end, the quantity of modifiers available during a particular play or plays of the wagering game 530 can be dependent upon the size of the players bet or some other game-related or non-game-related factor, for example. Other modifier symbol options may include, in some non-limiting examples, stationary and/or non-stationary modifiers, placing modifiers on the display screen 514 prior to and/or during the triggering event, transmuting modifiers, disappearing modifiers, shrinking and/or expanding modifiers, etc. In addition, the modifiers can be shown or dispersed prior to or during the triggering event, as well as or rather than afterwards, as shown (e.g., to heighten anticipation).

Figure 6:
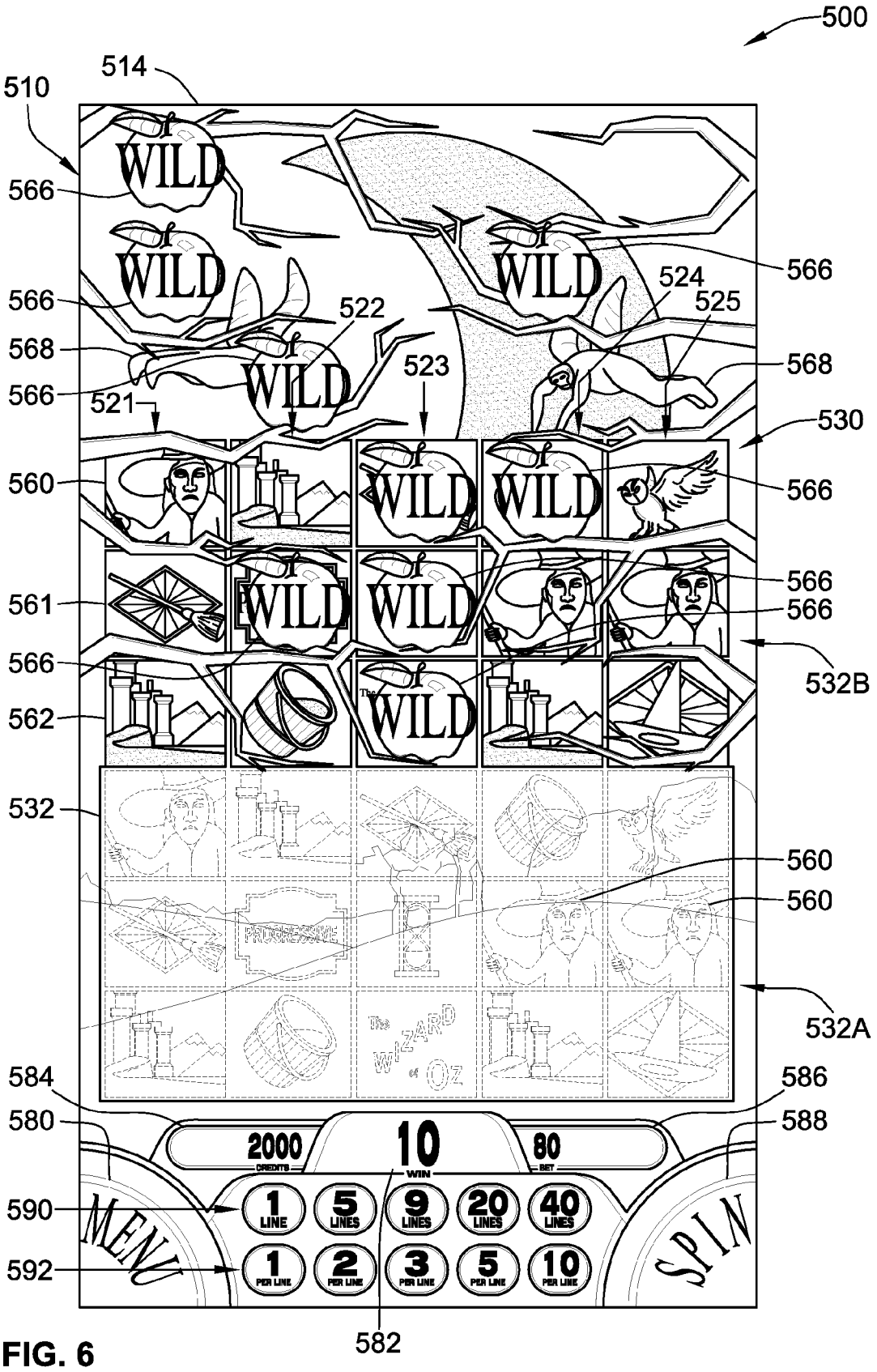
FIG. 6 is another screen shot of the bonus-game screen of FIG. 5, illustrating the entire symbol array being moved, as a unit, relative to modifiers located outside the original position of the array.

One or more of the modifier symbols 566 are collected, achieved or otherwise activated by the array 532 via movement thereof from the first position 532A to a second position, represented herein at 532B in FIG. 6. As noted above, the symbols in the array 532 located at the first position 532A on the display device 514 are indicative of a randomly determined outcome of the wagering game 530. In some embodiments, a value associated with the displayed wagering-game outcome, if any, is determined. As seen in FIG. 6, for example, two "wicked witch" symbols 560 aligned along an active payline may have a 10-credit award associated therewith, which can be conferred upon the player and contemporaneously displayed via the WIN meter 582. Alternatively, determining the value associated with the wagering-game outcome may be delayed until after the array 532 is moved to the second position 532B. After the reels 521-525 stop spinning, a pair of flying monkeys 568 soar onto the display screen 514, grab the array 532, and move the symbol array 532 to a new position. In FIG. 6, the entire array of symbols 532 is moved from the first position to the second position as a single unit. Rather than moving just a single symbol or a single reel, or repositioning the reels 521-525 piecemeal or sequentially, the illustrated embodiment conjointly repositions all five of the symbol-bearing reels 521-525 at one time. In the illustrated embodiment, the array 532 is moved after the reels 521-525 stop spinning and the wagering-game outcome is displayed, but prior to displaying new symbols in the array 532 indicative of a second wagering-game outcome.

Alternatively, the array 532 may be moved prior to or while the reels 521-525 are spinning. In another optional variation, the entire symbol array 532 need not move in unison; rather, a single reel (or selected ones of the reels 521-525) could be moved or flung around the display screen to collect or otherwise activate modifiers, and then, in some embodiments, return to its original position in the array 532. Moreover, all of the reels 521-525 in the array 532 (or all 15 symbol positions) could break apart, fly around the display screen collecting or activating modifiers, and then reassemble, e.g., in the same positions as before the array broke apart, in new positions, or in new arrangements. Another optional feature can include scrolling or otherwise moving the environment behind the reels 521-525 such that array 532 is not limited to the initial display area (e.g., can exceed the screen "real estate"), and also give the illusion that the reels have been flung or otherwise moved into an unseen segment or segments.

With continuing reference to the example portrayed in FIG. 6, the second position 532B of the array 532 is a "stopping position" where the array 532 discontinues movement, at a minimum, for a visually perceptible period of time. The second ("stopping") position 532B may be randomly determined via the gaming system 500, e.g., via one or more processors, without any influence by the player. Alternatively, the second position 532B of the array 532 is determined, at least in part (and, in some embodiments, entirely), by a movement instruction received from a player via an input device, such as the button panel 36 or touch screen 38 of FIG. 1A, or any of the other player-input device options disclosed herein, as well as others now known or hereinafter developed. In some embodiments, modifiers can be collected by the array 532 as it moves throughout the display screen 514 between its first (starting) position 532A and second (stopping) position 532B. For the embodiment portrayed in FIGS. 5-8, the achieved modifier(s) depend, at least in part, upon the final stopping position of the array 532. In this instance, the stopping position 532B of the array 532 locates the array 532 behind the branches 564 such that one or more of the modifier symbols 566 are positioned over symbols in the array 532. Five WILD modifier symbols 566 are shown in FIG. 6 each positioned over a respective symbol in the array 532 when the array 532 comes to rest at the stopping position 532B—one modifier symbol 566 covers each of the following displayed symbol positions: second reel 522, second row; third reel 523, first, second and third rows; and fourth reel 524, first row. Greater or fewer than five modifiers may be achieved during movement of the array 532 without departing from the intended scope of the present disclosure.

Modifier symbols 566 need not necessarily be positioned directly over a symbol to modify that symbol. One non-limiting alternative can include a modifier symbol 566 that is an "expanding wild" symbol, which operates to expand over, cover, and thereby modify multiple symbols in the repositioned array 532. Another option may include a modifier symbol 566 that modifies all symbols within a predetermined proximity, those immediately next to the modifier symbol, and/or those at least partially covered by the modifier symbol. In another non-limiting example, a modifier symbol 566 may be positioned behind (e.g., under the array 532) the symbols it is modifying.

The value of the wagering-game outcome, as displayed by the symbol array 532, is altered based upon the modifier(s) achieved as a result of movement of the array 532. The modifier symbols 566, in various embodiments, operate to supplement or otherwise enhance one or more symbols on the reels 521-525 in the array 532. In one example, a modifier symbol 566 may indicate a numerical multiplier which increases the award value associated with a specific winning symbol-combination or the overall value of a game outcome. Another example may include a modifier symbol 566 that indicates a supplemental credit value which is added to the award value associated with a specific winning symbol-combination or the overall value of a game outcome. In alternative embodiments, one or more of the modifier symbols 566 may operate to diminish or otherwise devalue one or more symbols or symbol combinations on the reels 521-525 in the array 532.

Figure 7:
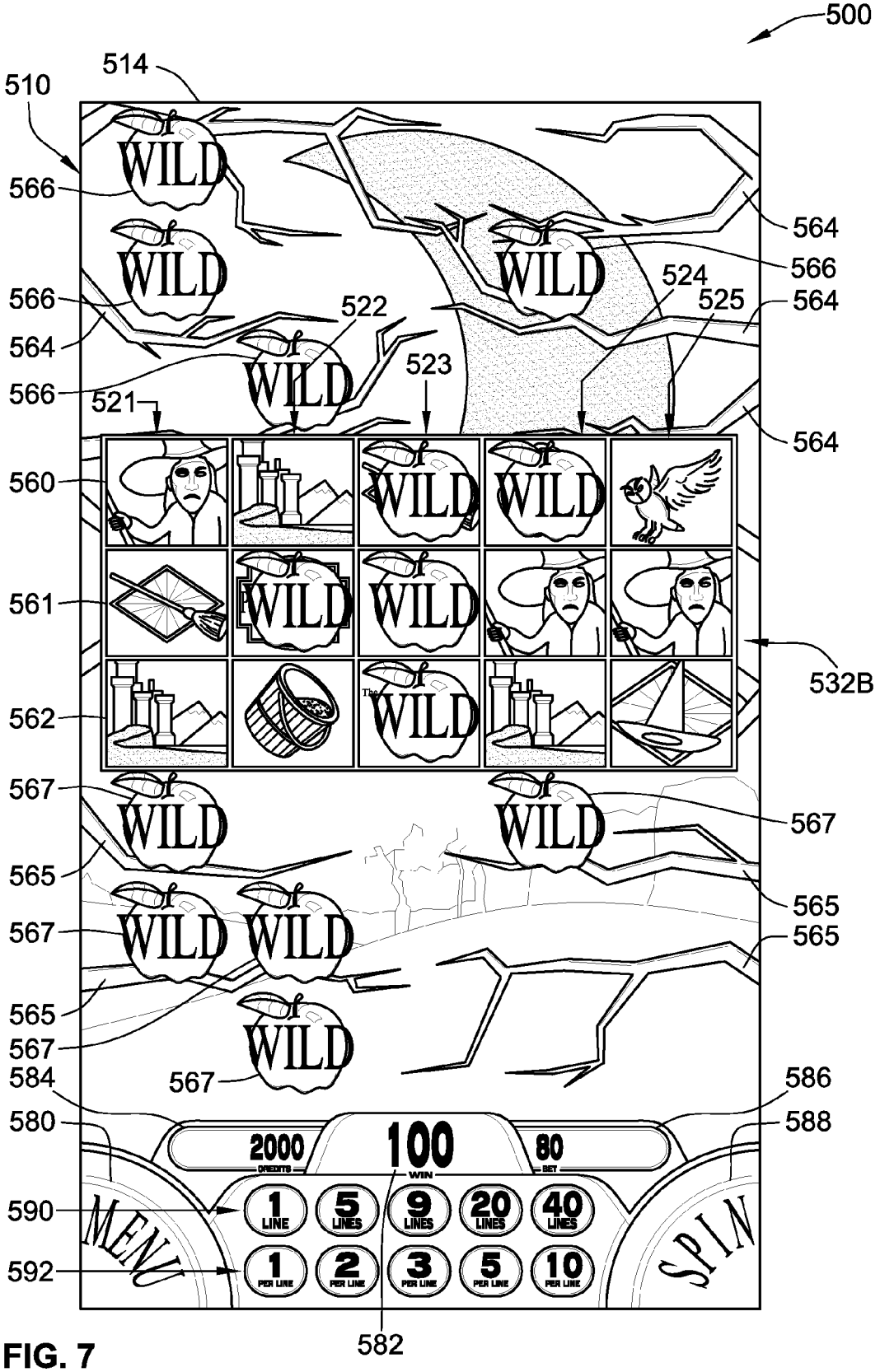
FIG. 7 is another screen shot of the bonus-game screen of FIG. 6, showing modifiers collected during movement of the symbol array altering an outcome of the wagering game, and showing the generation of new modifiers outside the current position of the symbol array.

In the embodiment illustrated in FIGS. 6 and 7, each of the five "collected" modifier symbols 566 replaces the respective symbol in the array 532 over which it is located. The addition of five WILD symbols 566 to the symbol array 532 when moved to the second ("stopping") position 532B enlarges the value of the previously existing winning symbol-combination (FIG. 6) and increases the number of winning symbol-combinations in the wagering-game outcome (FIG. 7), thus, increasing the overall value of the displayed wagering-game outcome. As seen in FIG. 7, the initial value of the wagering-game outcome (e.g., the 10-credit award shown in FIG. 6) is increased to 100 credits, which can be conferred upon the player and contemporaneously displayed via the WIN meter 582. The modifier symbols 566 may take on other forms within the scope of this disclosure, including progressive-jackpot symbols, bonus-game triggering symbols, high-value (H1) symbols, etc. One optional configuration may include valuating the symbols in the array 532 when located at the first position 532A, paying out a corresponding number of credits based upon this evaluation, then moving the symbol array 532, reevaluating the array of symbols 532 as modified at the second position 532B, and paying out a second number of credits based upon the latter evaluation. Alternatively, the symbols in the array 532 are only evaluated for winning outcomes after being modified at the second position 532B; a single award of credits can then be conferred upon the player based upon this sole evaluation.

In addition to showing the five modifier symbols 566 "collected" during movement of the symbol array 532 altering an outcome of the wagering game, FIG. 7 also depicts the generation of new modifier symbols (collectively designated at 567) outside the current position of the symbol array. Similar to the illustration in FIG. 5, FIG. 7 depicts throngs of new branches 565 growing into and over the display screen 514; in this instance, the branches 565 are shown growing below the reels 521-525. Like the modifier symbols 566, the new modifier symbols 567 are also represented by apple-shaped WILD modifier symbols growing on the new branches 565 at different locations on the display screen 514. In this particular embodiment, each new modifier symbol 567 is located outside the second position 532B of the array 532 at a respective position on the display device 514, vertically aligned below at least one of the symbol-bearing reels 521-525. Some of the modifier symbols 567 are also shown in rows, horizontally aligned with other modifier symbols 567. Optionally, new modifier symbols 567 can appear at locations above the symbol array 532. These new modifier symbols 567, individually or collectively, can include any of the optional or alternative features discussed above with respect to the symbol modifiers 566.

Figure 8:
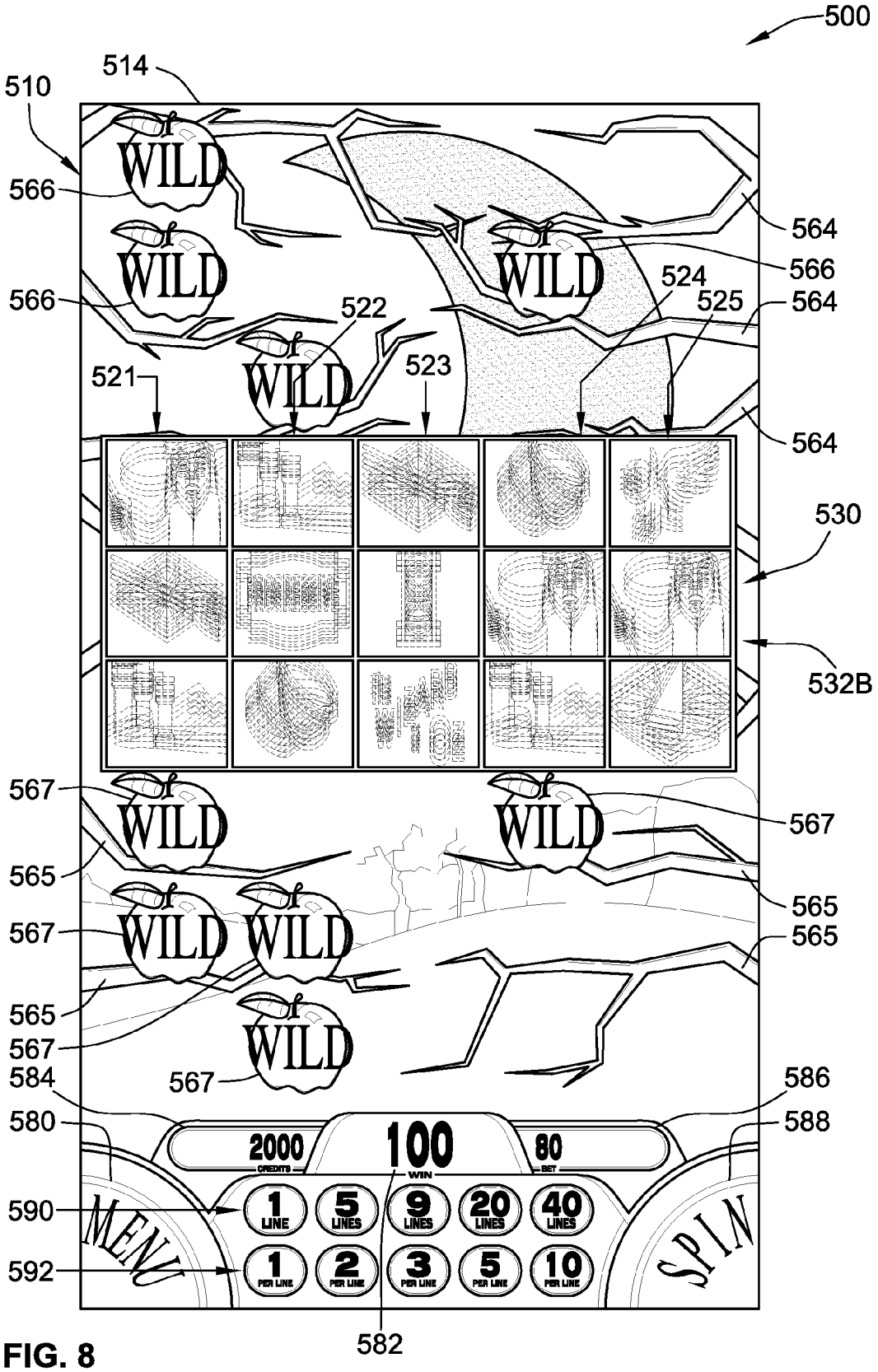
FIG. 8 is another screen shot of the bonus-game screen of FIG. 6, showing the removal of previously used modifiers and the initiation of another play of the bonus game.

FIG. 8 shows the wagering game 530 removing the five previously used modifier symbol 566. In the illustrated embodiment, for example, these five modifier symbol 566 slowly fade away and disappear. Optional arrangements can include the apple-shaped WILD modifier symbols 533 withering away and deteriorating until they disappear or fall off. Alternatively, the apple-shaped WILD modifier symbols 533 can be picked or shaken off by one of the flying monkeys 568 illustrated in FIG. 6. In this regard, all or randomly selected ones of the originally generated modifier symbols 566 can disappear between sequential plays of the Flying-Monkey Wild Feature. Antithetically, one or more of the originally generated modifier symbols 566 can remain between sequential plays of the Flying-Monkey Wild Feature. One non-limiting example includes one or more of the previously used modifier symbols 566 acting as "sticky symbols" that "attach" to the array 532 and, thus, remain in play for subsequent plays of the wagering game.

FIG. 8 also shows the wagering game 530 after another play of a base game or bonus game segment is initiated. In a free-spin bonus-game implementation, FIG. 8 may be representative of a second free-spin in a number of computer-initiated free spins. This subsequent play of the wagering game 530 may include, for example, determining a second outcome of the wagering game 530, and thereafter displaying, in the array 532 located at the second position 532B on the display device 514, a second plurality of symbols indicative of the second wagering-game outcome. Similar to the aspects described above with respect to FIGS. 5-7, a value associated with the second wagering-game outcome can be determined, while the array 532 is contemporaneously moved from the second position 532B to a third position (e.g., back to the first position 532A or another location) on the display device 514. The "second" value associated with the second wagering-game outcome is then modified based upon one or more modifiers achieved due to movement of the array 532 to the third position.

Figure 9:
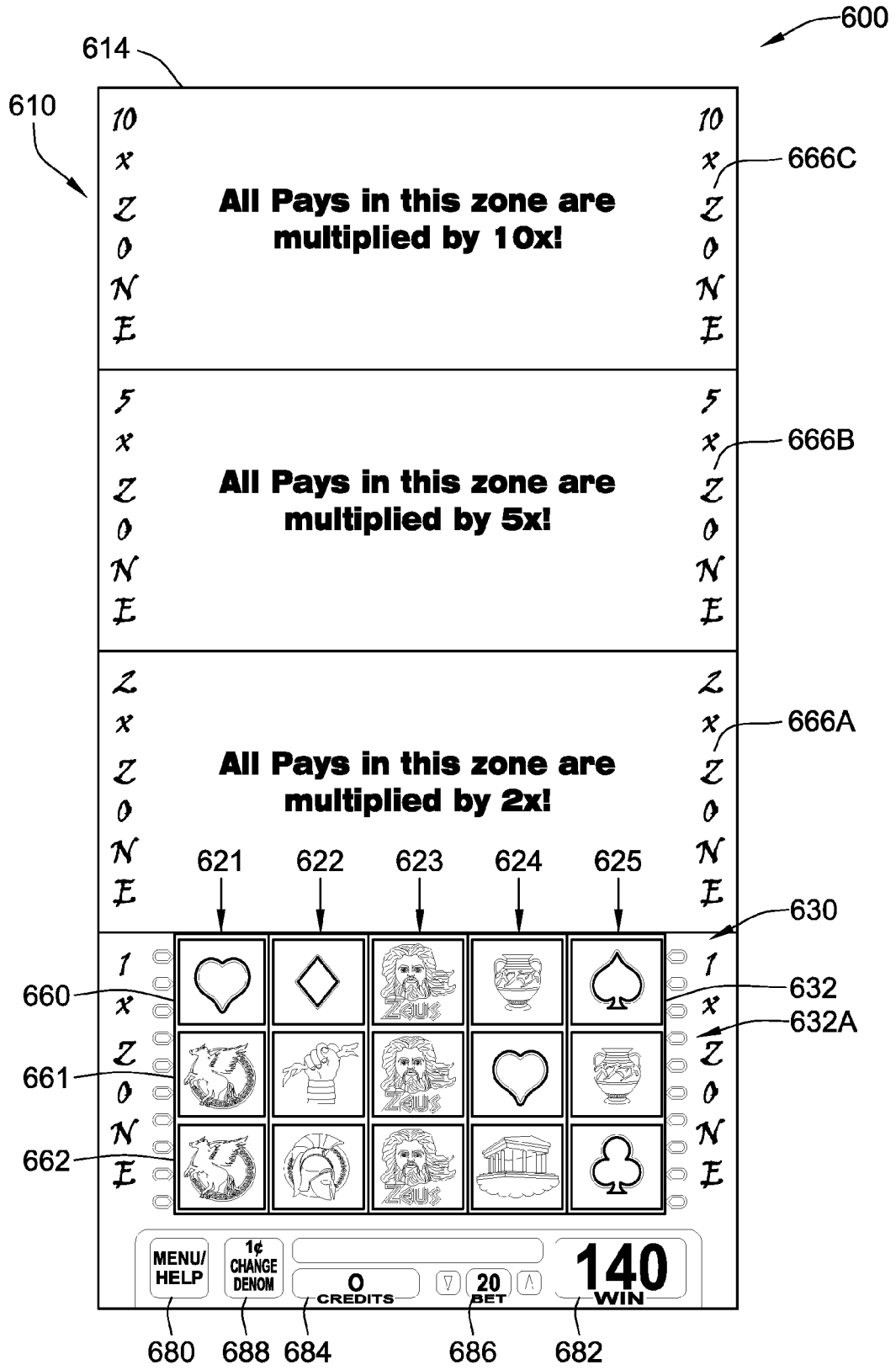
FIG. 9 is a screen shot of another basic-game screen from an exemplary wagering game in accordance with aspects of the present disclosure.

With reference to FIG. 9, a screen shot of a game screen from another exemplary wagering game is shown in accordance with aspects of the present disclosure. A primary display 614 of a gaming device or terminal 610, which may be part of an exemplary gaming system 600, is portrayed in FIG. 9. The gaming terminal 610 of FIG. 9 can take on any of the various forms, optional configurations, and functional alternatives described with respect to the embodiments presented hereinabove. For instance, the primary display 614 of the gaming terminal 610 displays wagering games, including any of those described above with respect to FIGS. 3-8 or those described below with respect to FIGS. 9-13.

The display 614 displays or otherwise visually depicts a wagering game 630, which in this example is the slot game shown in FIG. 6. The slot game 630 includes a plurality of symbol-bearing reels, designated generally as 621-625, respectively, each having a plurality of distinct symbol positions and bearing a number of symbols (collectively represented by symbols 660-662 in FIG. 6). The symbols on the reels 621-625 are arranged in an array 632, which in this embodiment is a 3×5 matrix of symbols. These reels 621-625 are varied (e.g., spun and stopped) to reveal combinations of symbols in the array 632, which represent randomly selected outcomes of the wagering game 630, that are evaluated for winning combinations. Winning combinations of symbols landing, for example, on activated paylines, cause awards to be paid in accordance with one or more pay tables associated with the gaming system 600. Unless otherwise logically prohibited, the wagering game 630 may include any of the optional or alternative features described above with respect to the wagering game 530 in FIGS. 5-8.

The primary display 614 further includes certain display features for providing information and options to a player. These display 614 features may include, for example, a MENU button 680, a WIN meter 682, a CREDITS meter 684, a BET meter 686, and a CHANGE DENOM button 688, each of which may functionally similar to the corresponding meters and buttons described above with respect to the primary display 514 in FIG. 5. In this vein, the additional and alternative display features discussed above may also be incorporated into the primary display 614 of FIG. 9.

Figure 10:
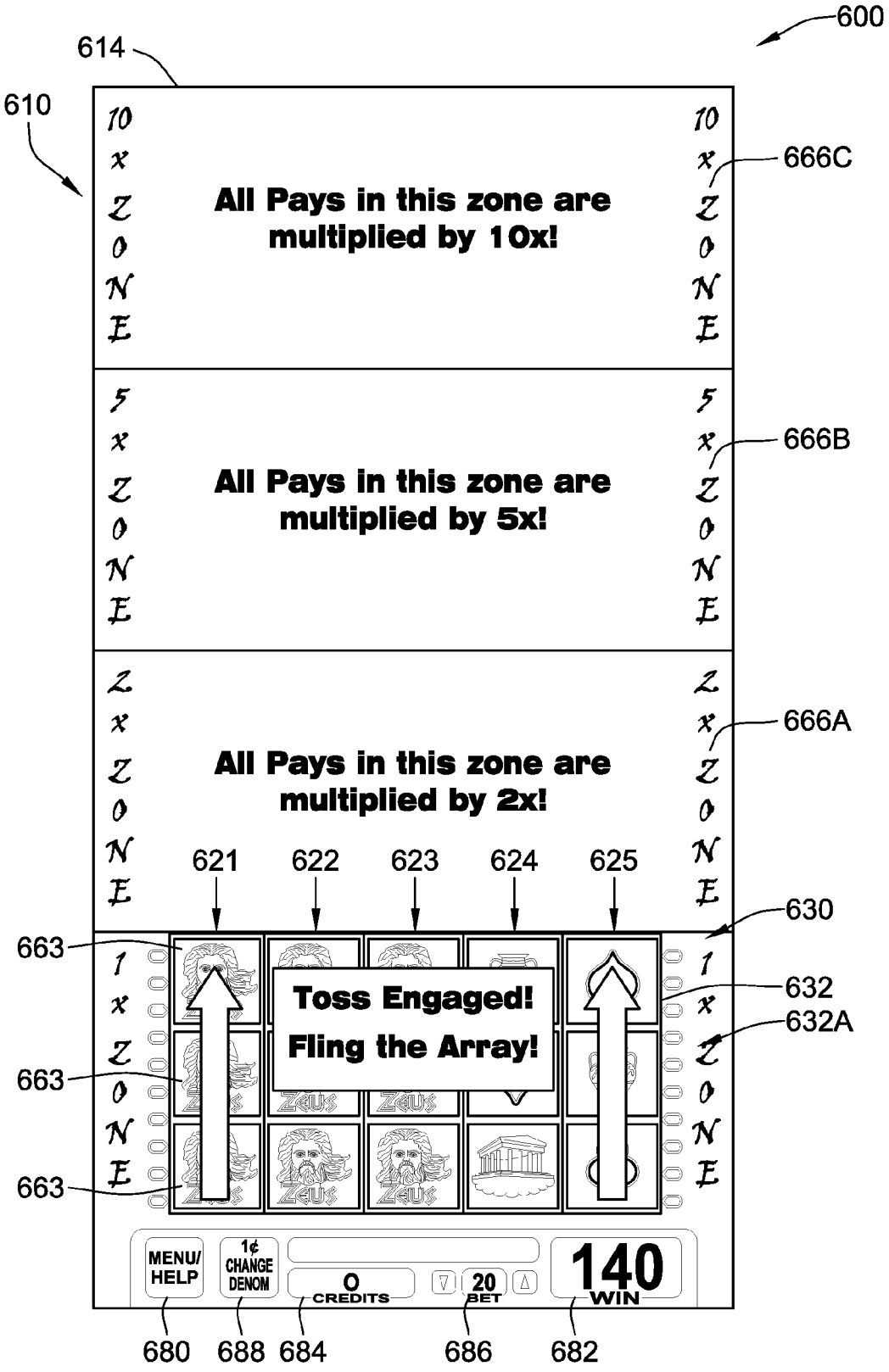
FIG. 10 is another screen shot of the basic-game screen of FIG. 9, showing the triggering of a reel-toss feature in accordance with aspects of the present disclosure.

The wagering game 630 is shown in FIG. 9 after play of a base game or bonus game segment is initiated, and the reels 621-625 have been spun and stopped. This wagering-game outcome can be randomly selected from a plurality of potential wagering-game outcomes (e.g., using, for example, a local random number generator (RNG)). During play of the wagering game 630, e.g., prior to, during, or after the reels 621-625 are spun and stopped, a triggering event may trigger activation of one or more gaming features or special events. In the illustrated embodiment, a Reel Toss feature, which may be embodied in a basic game or a bonus game, is triggered as a result of a triggering event during the most recent play of the wagering game 630. This triggering event may include any known triggering event, including those described above with respect to FIG. 5. For instance, the triggering event may be a symbol-driven triggering event comprising at least one winning symbol-combination in the displayed wagering-game outcome. A triggering event is represented in FIG. 10 by a wagering-game outcome with one or more (seven as shown) top-symbol winning symbol-combinations. Many aspects of the Reel Toss feature are similarly amendable or otherwise adaptable for incorporation into other segments and aspects of wagering games, including, without limitation, community games, progressive games, etc.

A number of modifiers, represented in FIGS. 9-12 by a plurality of modifier zones 666A, 666B and 666C, are situated at different locations throughout the display screen 614. Specifically, a first modifier zone 666A, labeled as "2× ZONE" in FIG. 9, is associated with a corresponding multiplier value (e.g., 2×) and is positioned directly above the current ("first") position 632A of the array 632. A second modifier zone 666B, labeled as "5× ZONE" in FIG. 9, is associated with a corresponding multiplier value (e.g., 5×) and is positioned directly above the first modifier zone 666A and below the third modifier zone 666C. A third modifier zone 666A, labeled as "10× ZONE" in FIG. 9, is associated with a corresponding multiplier value (e.g., 10×) and is positioned at the top of the display device 614 above the first and second modifier zones 666A, 666B and the symbol array 632. In the illustrated embodiment, each modifier zone 666A, 666B, 666C spans the width of the display screen 614, and is sufficiently large to fit the entire symbol array 632 within its respective area.

Although shown as corresponding to a respective multiplier value, each of the modifier zones can be associated with other multiplier value or other modifying features without departing from the intended scope and spirit of the present disclosure. By way of example, and not limitation, each modifier zone 666A-C can be associated with a respective progressive jackpot level, bonus credit value, bonus game, symbol modifier (e.g., replaces all heart symbols 660 with a ZEUS symbol 663), number of symbol modifiers (e.g., adds five WILD symbols to the array 632), payline activator (e.g., activates three additional paylines), reel modifier (e.g., changes all symbols on the third reel 653 to WILD symbols), etc. Recognizably, the shape, size and positioning of the modifier zones 666A, 666B, 666C can be varied from what is shown in the drawings without departing from the intended scope of the present disclosure. Moreover, the number of available modifier zones may be varied from the three presented in FIGS. 9-12. To that end, the value of each modifier zone (i.e., the magnitude of the multiplier associated with the zone) can be dependent upon the size of the players bet or some other game-related or non-game-related factor, for example. Other modifier zone options may include, in some non-limiting examples, stationary and/or non-stationary modifier zones, transforming modifier zones, disappearing and/or reappearing modifier zones, shrinking and/or expanding modifier zones, etc.

Figure 11:
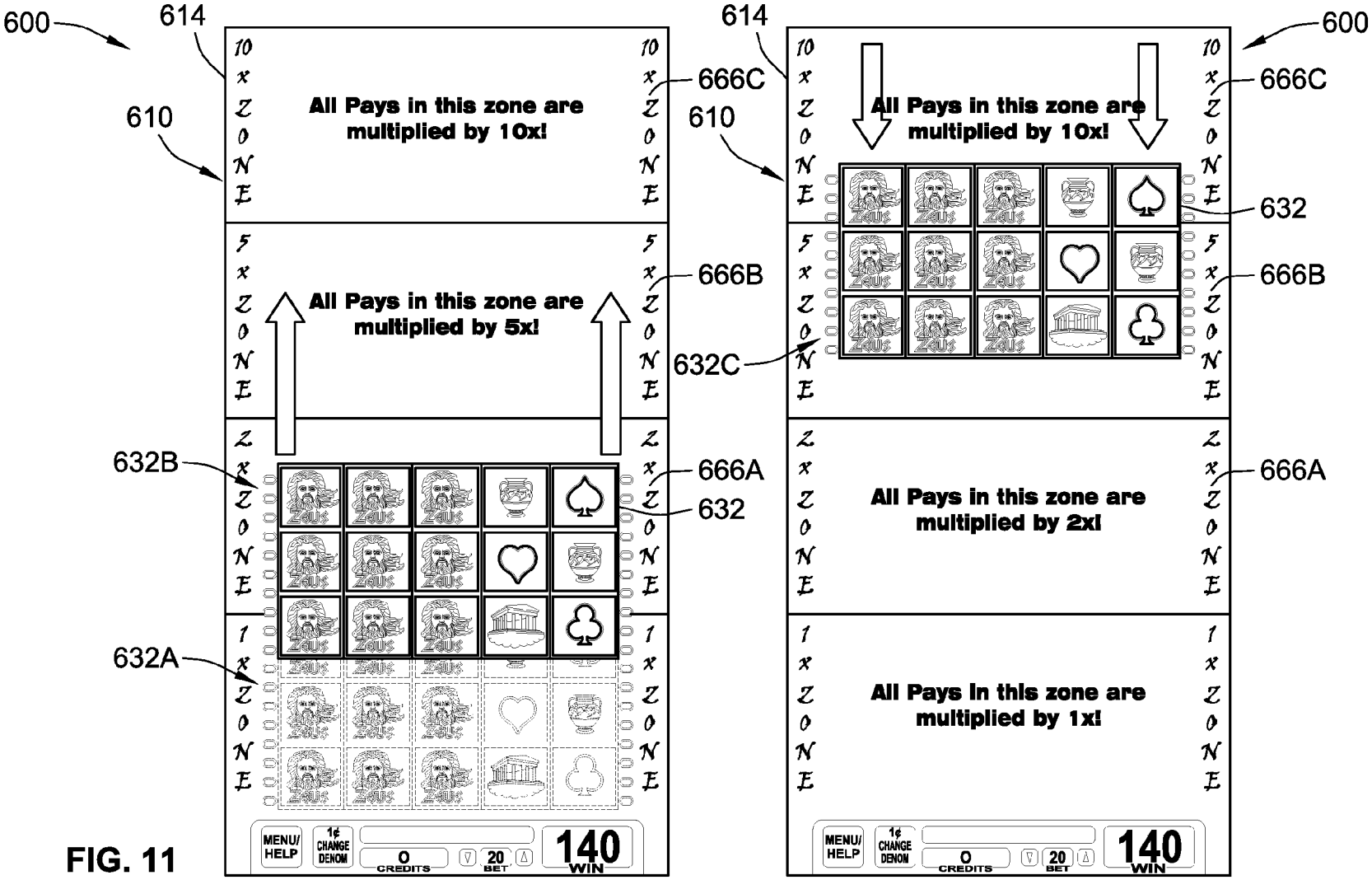
FIG. 11 is another screen shot of the basic-game screen of FIG. 9, illustrating the entire symbol array being moved, as a unit, relative to modifiers located outside the original position of the array.

One or more of the modifier zones 666A, 666B, 666C are collected, achieved or otherwise activated by the array 632 via movement thereof from the first position 632A to a second position. The symbols in the array 632 located at the first position 632A on the display device 614 in FIG. 10 are indicative of a randomly determined outcome of the wagering game 630. Aligned along each of seven active paylines in FIG. 10 are three ZEUS symbols 663, providing an initial total award value of 140 credits, for example. When the reels 621-625 stop spinning and the displayed wagering-game outcome is revealed and evaluated for winning symbol combinations, the primary display 614 indicates to the player that the Reel Toss feature has been engaged (e.g., "Toss Engaged!") and the player is prompted to enter a movement instruction (e.g., "Fling the Array!"). The player then enters a movement instruction via a player input device, such as the input devices described above with respect to FIG. 6. In some non-limiting examples, the player can enter a movement instruction by pressing one or more of the buttons on the button panel 36 or touch screen 38 of FIG. 1A, or performing a swiping motion with their hand across the touch screen 38, an electronic trackball, or any of the other player-input device options disclosed herein. FIG. 11 shows the array 632 being "flung" or otherwise moved from its first ("initial") position 632A, traversing through second and third ("intermediate") positions 632B and 632C, respectively, and coming to rest at a fourth ("stopping") position 632D, exemplified in FIG. 12.

Figure 12:
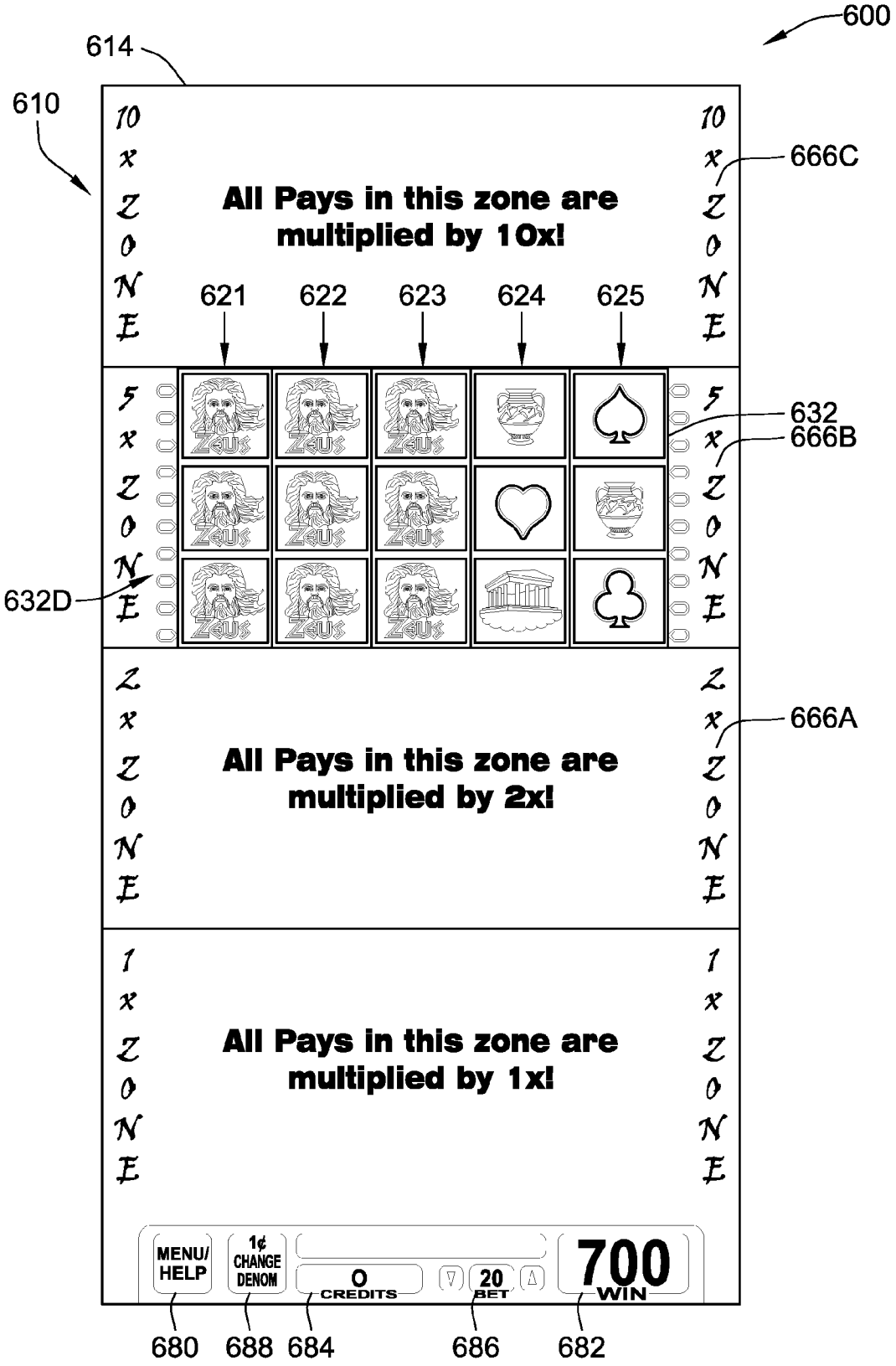
FIG. 12 is another screen shot of the basic-game screen of FIG. 9, illustrating a modifier activated during movement of the symbol array altering an outcome of the wagering game.

For the embodiment portrayed in FIGS. 9-12, the stopping position locates the array 632 within one or more of the modifier zones 666A-C displayed via the display device 614. FIG. 12, for example, shows the array 632 stopping at the fourth position 632D, which locates the entire symbol array 632 inside the second modifier zone 666B. Optionally, the array 632 could come to rest at a stopping position such that individual portions of the array 632 (e.g., one or more rows or one or more columns of the array 632) are positioned in separate modifier zones. Other optional arrangements may include the array bouncing off the top, bottom, and/or sides, of the display screen 614. It is also envisioned that the array 632 be moved in a 3-dimensional environment, be moved according to real-time physics, be moved in a predetermined "scripted" manner, etc. For the embodiment portrayed in FIGS. 9-12, the achieved modifier(s) depend, at least in part, upon the final stopping position of the array 632. By stopping in the second modifier zone 666B, the initial total award value of 140 credits is multiplied by five (i.e., "5×") for a total, final payout of 700 credits, which can then be conferred upon the player and contemporaneously displayed via the WIN meter 682. The array 632 may then be flung one or more additional times.

Figure 13:
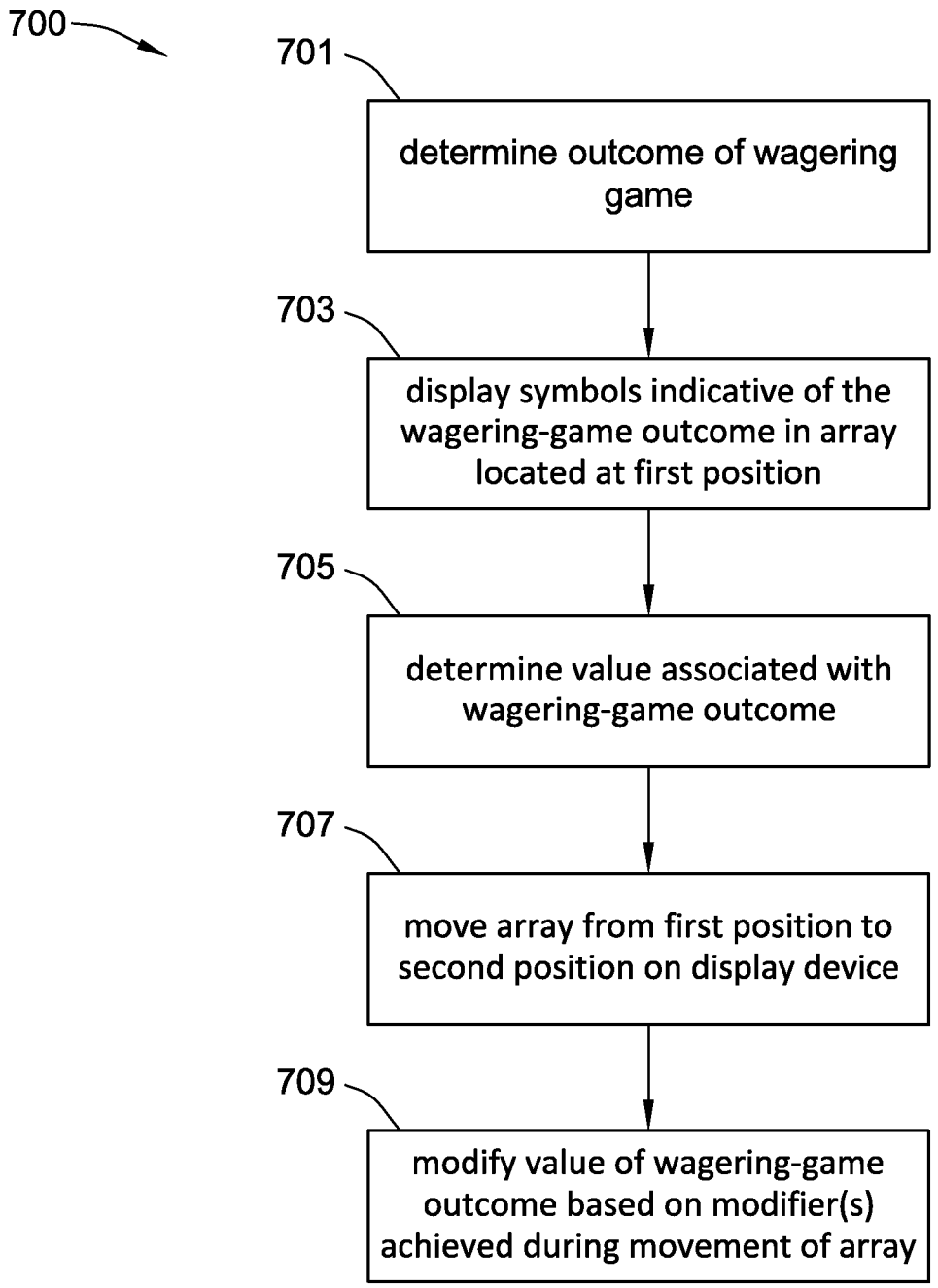
FIG. 13 is a flowchart for an exemplary method or algorithm that can correspond to instructions that can be stored on a non-transitory computer-readable medium and can be executed by a controller in accord with at least some aspects of the disclosed concepts.

With reference now to the flow chart of FIG. 13, an improved method for conducting a wagering game on a gaming terminal, such as one of the gaming terminals shown in FIGS. 1A, 1B and 5, and/or a gaming system, such one of the gaming systems shown in FIGS. 2 and 5, is generally described at 700 in accordance with aspects of the present disclosure. FIG. 13 can be representative of an algorithm that corresponds to at least some instructions that can be stored, for example, in memory 44 of FIG. 2, and executed, for example, by the controller 42 and/or external system(s) 46 of FIG. 2 to perform any or all of the above or below described functions associated with the disclosed concepts. The method 700 will be described with reference to the various aspects and features shown in FIGS. 5-12 of the drawings; such reference is being provided purely by way of explanation and clarification.

The method 700 begins at block 701 by determining an outcome of a wagering game. This may include, as indicated above, a wager input device receiving an indication of a wager placed by a player, an RNG reactively generating a random number, and game logic for determining the outcome based on the randomly generated number. At block 703, the method 700 includes displaying, in a symbol array located at a first position on a display device, a plurality of symbols indicative of the wagering-game outcome. This may include, for example, the controller 42, the external system 46, or both, in alternative embodiments, operating to execute a wagering game program, and game assets (e.g., art, sound, etc.) for presenting the determined outcome to a player in a visual manner.

The method 700 continues to block 705, where a value associated with the displayed wagering-game outcome is determined. Symbol combinations can be evaluated, for example, according to various schemes, such as line pays, scatter pays, or any other known method, and in accordance with one or more pay tables associated with the wagering game. At block 707, the entire array of symbols is moved, as a unit, from the first "starting" position to a second "stopping" position on a display device. This may include receiving, via a player input device, a movement instruction from a player. In this instance, the second position of the array is based, at least in part, on the movement instruction received from the player. Optionally, the second position of the array can be randomly determined, in whole or in part, via one or more processors.

At block 709, the value of the wagering-game outcome is modified based upon one or more modifiers achieved due to movement of the array to the second position. Modifiers may be "achieved"—e.g., accumulated and/or activated, by way of any of the optional means described herein. Moreover, these modifiers can take on the form of any of the illustrated modifiers or optional and alternative modifiers described herein. For example, the second position may be a stopping position which locates the array within at least one of a plurality of modifier zones, such as the modifier zones described above with respect to FIGS. 9-12. Alternatively, each of the modifiers may be a modifier symbol, such as those described above with respect to FIGS. 5-8, located at a respective position on the display device.

In some embodiments, the method 700 includes at least those steps enumerated above. It is also within the scope and spirit of the present invention to omit steps, include additional steps, and/or modify the order presented above. It should be further noted that the method 700 represents a single play of a wagering game. However, it is expected that the method 700 be applied in a systematic and repetitive manner.

Aspects of this disclosure can be implemented, in some embodiments, through a computer-executable program of instructions, such as program modules, generally referred to as software applications or application programs executed by a computer. The software can include, in non-limiting examples, routines, programs, objects, components, and data structures that perform particular tasks or implement particular abstract data types. The software forms an interface to allow a computer to react according to a source of input. The software can also cooperate with other code segments to initiate a variety of tasks in response to data received in conjunction with the source of the received data. The software can be stored on any of a variety of memory media, such as CD-ROM, magnetic disk, bubble memory, and semiconductor memory (e.g., various types of RAM or ROM).

Moreover, numerous aspects of the present disclosure can be practiced with a variety of computer-system and computer-network configurations, including hand-held devices, multiprocessor systems, microprocessor-based or programmable-consumer electronics, minicomputers, mainframe computers, and the like. In addition, aspects of the present disclosure can be practiced in distributed-computing environments where tasks are performed by remote-processing devices that are linked through a communications network. In a distributed-computing environment, program modules can be located in both local and remote computer-storage media including memory storage devices. Aspects of the present disclosure can therefore, be implemented in connection with various hardware, software or a combination thereof, in a computer system or other processing system.

Any of the methods described herein can include machine readable instructions for execution by: (a) a processor, (b) a controller, and/or (c) any other suitable processing device. Any algorithm, software, or method disclosed herein can be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well known manner (e.g., it can be implemented by an application specific integrated circuit (ASIC), a programmable logic device (PLD), a field programmable logic device (FPLD), discrete logic, etc.). Also, some or all of the machine readable instructions represented in any flowchart depicted herein can be implemented manually. Further, although specific algorithms are described with reference to flowcharts depicted herein, persons of ordinary skill in the art will readily appreciate that many other methods of implementing the example machine readable instructions can alternatively be used. For example, the order of execution of the blocks can be changed, and/or some of the blocks described can be changed, eliminated, or combined.

It should be noted that the algorithms illustrated and discussed herein as having various modules or blocks that perform particular functions and interact with one another. It should be understood that these modules are merely segregated based on their function for the sake of description and represent computer hardware and/or executable software code which is stored on a computer-readable medium for execution on appropriate computing hardware. The various functions of the different modules and units can be combined or segregated as hardware and/or software stored on a non-transitory computer-readable medium as above as modules in any manner, and can be used separately or in combination.

While many preferred embodiments and best modes for carrying out the present invention have been described in detail above, those familiar with the art to which this invention relates will recognize various alternative designs and embodiments for practicing the invention within the scope of the appended claims.

What is claimed is:

1. A gaming system, comprising:

a gaming machine primarily dedicated to playing at least one casino wagering game, the gaming machine including an electronic display device and one or more electronic input devices; and game-logic circuitry configured to:

detect, via at least one of the one or more electronic input devices, a physical item associated with a monetary value that establishes a credit balance;

initiate the casino wagering game in response to an input indicative of a wager covered by the credit balance;

display a plurality of symbol-bearing reels in a first region on the electronic display device;

display one or more modifiers in a second region on the electronic display device, the second region being distinct from the first region;

rotate and stop the plurality of symbol-bearing reels to expose a plurality of symbols indicative of an outcome of the casino wagering game;

move the plurality of symbol-bearing reels as a single unit from the first region to the second region;

display, on the electronic display device, the exposed plurality of symbols in visual association with the one or more modifiers in the second region;

modify the outcome by applying the one or more modifiers to the exposed plurality of symbols; and receive, via at least one of the one or more electronic input devices, a cashout input that initiates a payout from the credit balance.

2. The gaming system of claim 1, wherein the game-logic circuitry is configured to rotate and stop the plurality of symbol-bearing reels prior to moving the plurality of symbol-bearing reels from the first region to the second region.

3. The gaming system of claim 1, wherein the second region is a stopping position randomly determined by the game-logic circuitry.

4. The gaming system of claim 3, wherein the one or more modifiers depend upon the stopping position.

5. The gaming system of claim 4, wherein the stopping position locates the plurality of symbol-bearing reels within at least one of a plurality of modifier zones displayed on the electronic display device, each of the modifiers corresponding to a respective one of the modifier zones.

6. The gaming system of claim 5, wherein the one or more modifiers are respective multipliers that multiply a value of the outcome.

7. The gaming system of claim 3, wherein each of the modifiers is a modifier symbol located at a respective position on the electronic display device, and wherein one or more of the modifier symbols are collected by the plurality of symbol-bearing reels via movement thereof from the first region to the second region.

8. The gaming system of claim 7, wherein each of the modifier symbols operates to enhance at least one exposed symbol of the exposed plurality of symbols.

9. The gaming system of claim 7, wherein the stopping position locates one or more of the modifier symbols over one or more of exposed symbols of the exposed plurality of symbols, each of the modifier symbols replacing each exposed symbol over which it is located.

10. A casino wagering game machine primarily dedicated to playing at least one casino wagering game, comprising:

an electronic display device coupled to the gaming cabinet;

one or more electronic input devices coupled to the gaming cabinet; and a casino wagering game machine primarily dedicated to playing at least one casino wagering game, the casino wagering game machine including an electronic display device and one or more electronic input devices; and game-logic circuitry configured to:

detect, via at least one of the one or more electronic input devices, a physical item associated with a monetary value that establishes a credit balance;

initiate the casino wagering game in response to an input indicative of a wager covered by the credit balance;

display a plurality of symbol-bearing reels in a first region on the electronic display device;

display one or more modifiers in a second region on the electronic display device, the second region being distinct from the first region;

rotate and stop the plurality of symbol-bearing reels to expose a plurality of symbols indicative of an outcome of the casino wagering game;

move the plurality of symbol-bearing reels as a single unit from the first region to the second region;

display, on the electronic display device, the exposed plurality of symbols in visual association with the one or more modifiers in the second region;

modify the outcome by applying the one or more modifiers to the exposed plurality of symbols; and receive, via at least one of the one or more electronic input devices, a cashout input that initiates a payout from the credit balance.

11. The casino wagering game machine of claim 10, wherein the game-logic circuitry is configured to rotate and stop the plurality of symbol-bearing reels prior to moving the plurality of symbol-bearing reels from the first region to the second region.

12. The casino wagering game machine of claim 10, wherein the second region is a stopping position randomly determined by the game-logic circuitry.

13. The casino wagering game machine of claim 12, wherein the one or more modifiers depend upon the stopping position.

14. The casino wagering game machine of claim 13, wherein the stopping position locates the plurality of symbol-bearing reels within at least one of a plurality of modifier zones displayed on the electronic display device, each of the modifiers corresponding to a respective one of the modifier zones.

15. The casino wagering game machine of claim 12, wherein each of the modifiers is a modifier symbol located at a respective position on the electronic display device, and wherein one or more of the modifier symbols are collected by the plurality of symbol-bearing reels via movement thereof from the first region to the second region.

16. A method of operating a gaming system, the gaming system including game-logic circuitry and a gaming machine, the gaming machine primarily dedicated to playing at least one casino wagering game primarily dedicated to playing at least one casino wagering game, the gaming machine including an electronic display device and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

displaying a plurality of symbol-bearing reels in a first region on the electronic display device;

displaying one or more modifiers in a second region on the electronic display device, the second region being distinct from the first region;

rotating and stopping the plurality of symbol-bearing reels to expose a plurality of symbols indicative of an outcome of the casino wagering game;

moving the plurality of symbol-bearing reels as a single unit from the first region to the second region;

displaying, on the electronic display device, the exposed plurality of symbols in visual association with the one or more modifiers in the second region;

modifying the outcome by applying the one or more modifiers to the exposed plurality of symbols; and receiving, via at least one of the one or more electronic input devices, a cashout input that initiates a payout from the credit balance.

17. The method of operating a gaming system according to claim 16, wherein the game-logic circuitry is configured to perform the acts of rotating and stopping of the plurality of symbol-bearing reels prior to moving the plurality of symbol-bearing reels from the first region to the second region.

18. The method of operating a gaming system according to claim 16, wherein the second region is a stopping position randomly determined by the game-logic circuitry.

19. The method of operating a gaming system according to claim 18, wherein the one or more modifiers depend upon the stopping position.

20. The method of operating a gaming system according to claim 19, wherein the stopping position locates the plurality of symbol-bearing reels within at least one of a plurality of modifier zones displayed on the electronic display device, each of the modifiers corresponding to a respective one of the modifier zones.

21. The method of operating a gaming system according to claim 20, wherein the one or more modifiers are respective multipliers that multiply a value of the outcome.

22. The method of operating a gaming system according to claim 16, wherein each of the modifiers is a modifier symbol located at a respective position on the electronic display device, and wherein one or more of the modifier symbols are collected by the plurality of symbol-bearing reels via movement thereof from the first region to the second region.

23. The method of operating a gaming system according to claim 22, wherein each of the modifier symbols operates to enhance at least one exposed symbol of the exposed plurality of symbols.

24. The method of operating a gaming system according to claim 22, wherein the stopping position locates one or more of the modifier symbols over one or more of exposed symbols of the exposed plurality of symbols, each of the modifier symbols replacing each exposed symbol over which it is located.

* * * * *